US011126097B2

(12) United States Patent
Ishida et al.

(10) Patent No.: US 11,126,097 B2
(45) Date of Patent: Sep. 21, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Tomohito Ishida, Suntou-gun (JP); Kaname Watariguchi, Yokohama (JP); Masataka Kawahara, Mishima (JP); Michiyo Sekiya, Atami (JP); Kohei Makisumi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/904,705

(22) Filed: Jun. 18, 2020

(65) Prior Publication Data

US 2020/0409280 A1 Dec. 31, 2020

(30) Foreign Application Priority Data

Jun. 25, 2019 (JP) ..... JP2019-117814
Jun. 11, 2020 (JP) ..... JP2020-101825

(51) Int. Cl.
*G03G 5/047* (2006.01)
*G03G 21/18* (2006.01)
*G03G 5/06* (2006.01)

(52) U.S. Cl.
CPC ..... *G03G 5/047* (2013.01); *G03G 5/0696* (2013.01); *G03G 21/1814* (2013.01)

(58) Field of Classification Search
CPC ..... G03G 5/047
See application file for complete search history.

(56) References Cited

U.S. PATENT DOCUMENTS 5,455,135 A 10/1995 Maruyama et al.
5,693,443 A 12/1997 Nakamura et al.
(Continued)

FOREIGN PATENT DOCUMENTS

JP 61-151665 * 10/1986 ..... G03G 15/00
JP S62-295057 12/1987
(Continued)

OTHER PUBLICATIONS

Translation of JP 61-151665.*
(Continued)

*Primary Examiner* — Peter L Vajda
(74) *Attorney, Agent, or Firm* — Venable LLP

(57) ABSTRACT

Provided is an electrophotographic photosensitive member in which discharge streaks generated in an end portion can be suppressed. The electrophotographic photosensitive member includes a cylindrical support, a charge-generating layer, and a charge-transporting layer in the stated order. In the electrophotographic photosensitive member, when a region between a center position and a 90% position situated at a 90% of a length of from the center position to one end of the electrophotographic photosensitive member in an axial direction thereof from the center position, is defined as a region X, and a region between the 90% position and the end of the electrophotographic photosensitive member is defined as a region Z. Average thicknesses in regions obtained by equally dividing the region X into five and regions obtained by equally dividing the region Z into three satisfy particular relationships.

7 Claims, 6 Drawing Sheets

(56) References Cited

U.S. PATENT DOCUMENTS

| | | | |
|---|---|---|---|
| 5,910,386 | A | 6/1999 | Yoshinaga et al. |
| 6,110,628 | A | 8/2000 | Sekiya et al. |
| 6,258,498 | B1 | 7/2001 | Kawahara et al. |
| 6,296,978 | B1 | 10/2001 | Takaya et al. |
| 6,372,397 | B1 | 4/2002 | Maruyama et al. |
| 6,436,597 | B2 | 8/2002 | Maruyama et al. |
| 6,551,752 | B2 | 4/2003 | Takaya et al. |
| 6,623,899 | B2 | 9/2003 | Takaya et al. |
| 6,664,014 | B1 | 12/2003 | Kikuchi et al. |
| 7,141,341 | B2 | 11/2006 | Sekido et al. |
| 7,333,752 | B2 | 2/2008 | Kawahara et al. |
| 7,378,205 | B2 | 5/2008 | Sekiya et al. |
| 7,551,878 | B2 | 6/2009 | Ogaki et al. |
| 7,622,238 | B2 | 11/2009 | Uematsu et al. |
| 7,629,102 | B2 | 12/2009 | Ochi et al. |
| 7,642,025 | B2 | 1/2010 | Tada et al. |
| 7,642,026 | B2 | 1/2010 | Tada et al. |
| 7,718,331 | B2 | 5/2010 | Uematsu et al. |
| 7,749,667 | B2 | 7/2010 | Kawahara et al. |
| 8,088,541 | B2 | 1/2012 | Tanaka et al. |
| 8,343,699 | B2 | 1/2013 | Nagasaka et al. |
| 8,465,889 | B2 | 6/2013 | Sekido et al. |
| 8,524,430 | B2 | 9/2013 | Takagi et al. |
| 8,546,050 | B2 | 10/2013 | Maruyama et al. |
| 8,632,931 | B2 | 1/2014 | Sekido et al. |
| 8,795,936 | B2 | 8/2014 | Sekido et al. |
| 8,841,052 | B2 | 9/2014 | Watariguchi et al. |
| 9,029,054 | B2 | 5/2015 | Okuda et al. |
| 9,063,505 | B2 | 6/2015 | Sekiya et al. |
| 9,068,083 | B2 | 6/2015 | Tanaka et al. |
| 9,069,267 | B2 | 6/2015 | Kaku et al. |
| 9,436,106 | B2 | 9/2016 | Kuno et al. |
| 9,459,542 | B2 | 10/2016 | Tanaka et al. |
| 9,459,545 | B2 | 10/2016 | Tanaka et al. |
| 9,500,966 | B2 | 11/2016 | Watariguchi et al. |
| 9,523,929 | B2 | 12/2016 | Nakamura et al. |
| 9,535,346 | B2 | 1/2017 | Sekiya et al. |
| 9,535,347 | B2 | 1/2017 | Watariguchi et al. |
| 9,541,850 | B2 | 1/2017 | Nishida et al. |
| 9,563,139 | B2 | 2/2017 | Kawahara et al. |
| 9,645,515 | B2 | 5/2017 | Kuno et al. |
| 9,645,516 | B2 | 5/2017 | Kawahara et al. |
| 9,720,337 | B2 | 8/2017 | Nishida et al. |
| 9,760,030 | B2 | 9/2017 | Sekiya et al. |
| 9,772,568 | B2 | 9/2017 | Sekido et al. |
| 9,811,011 | B2 | 11/2017 | Nishi et al. |
| 9,851,648 | B2 | 12/2017 | Nishi et al. |
| 9,864,285 | B2 | 1/2018 | Nishi et al. |
| 9,869,032 | B2 | 1/2018 | Kawahara et al. |
| 9,921,498 | B2 | 3/2018 | Sekido et al. |
| 10,372,050 | B2 | 8/2019 | Nishi et al. |
| 2008/0096123 | A1 | 4/2008 | Shimada et al. |
| 2009/0170023 | A1 | 7/2009 | Shimada et al. |
| 2014/0141362 | A1 | 5/2014 | Watariguchi et al. |
| 2015/0093693 | A1 | 4/2015 | Watariguchi et al. |
| 2015/0185630 | A1 | 7/2015 | Ito et al. |
| 2015/0185634 | A1 | 7/2015 | Sekiya et al. |
| 2015/0316863 | A1 | 11/2015 | Tanaka et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2016/0154326 | A1 | 6/2016 | Kumoi et al. |
| 2016/0154328 | A1 | 6/2016 | Kumoi et al. |
| 2016/0187794 | A1* | 6/2016 | Okuda ..... G03G 5/0567 430/56 |
| 2020/0159137 | A1 | 5/2020 | Ito et al. |
| 2020/0174385 | A1 | 6/2020 | Sakakibara et al. |

FOREIGN PATENT DOCUMENTS

| | | |
|---|---|---|
| JP | 2000-137340 | 5/2000 |
| JP | 2001-305838 | 11/2001 |
| JP | 2002-174910 | 6/2002 |
| JP | 2008-076656 | 4/2008 |
| JP | 2008-076657 | 4/2008 |

OTHER PUBLICATIONS

U.S. Appl. No. 16/891,525, Shuhei Iwasaki, filed Jun. 3, 2020.
U.S. Appl. No. 16/903,525, Kohei Makisumi, filed Jun. 17, 2020.
U.S. Appl. No. 16/904,700, Michiyo Sekiya, filed Jun. 18, 2020.
U.S. Appl. No. 16/905,427, Kaname Watariguchi, filed Jun. 18, 2020.
U.S. Appl. No. 17/065,258, Kohei Makisumi, filed Oct. 7, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

In recent years, as an exposing unit to be used in an electrophotographic apparatus, a semiconductor laser has become mainstream. In general, laser light output from a light source is scanned in an axial direction of a cylindrical electrophotographic photosensitive member (hereinafter sometimes simply referred to as "photosensitive member") by a laser scanning writing device. Through use of an optical system typified by a polygon mirror to be used in this case, various electrical correcting units, and the like, a light amount distribution is controlled so that an amount of light applied to the photosensitive member becomes uniform in the axial direction of the photosensitive member.

Due to a progress toward the reduction in cost of the polygon mirror and the downsizing of the optical system brought about by the improvement of an electrical correction technology and the like, an electrophotographic laser beam printer for personal use has come to be used, and in recent years, there has been a demand for further reduction in cost and downsizing thereof.

When the optical system is not elaborated or the electrical correction is not performed, the laser light that is scanned by the laser scanning writing device has a bias in a light amount distribution in the axial direction of the photosensitive member. In particular, the laser light is scanned by the polygon mirror or the like and hence causes a region in which a light amount is decreased from a center portion to an end portion in the axial direction of the photosensitive member. When such bias in the light amount distribution is uniformized by control through use of the optical system, the electrical correction, and the like, an increase in cost and an increase in size are caused.

In view of the foregoing, the following has hitherto been performed. In the photosensitive member, an exposure potential distribution in the axial direction of the photosensitive member is uniformized by providing a sensitivity distribution in the axial direction of the photosensitive member so as to cancel the bias in the light amount distribution.

As a method of providing an appropriate sensitivity distribution in the photosensitive member, it is conceivable to cause the electrostatic capacitance of a photosensitive layer in a single-layer photosensitive member or a charge-transporting layer in a laminated photosensitive member to have an appropriate distribution. As the electrostatic capacitance becomes smaller, the consumed charge amount required for reducing the exposure potential to a designated potential becomes smaller. Therefore, the exposure potential is easily reduced with respect to the light amount, and sensitivity is improved. As a method of causing the electrostatic capacitance to have an appropriate distribution, a method involving changing the thickness of the photosensitive layer or the charge-transporting layer has been known.

However, when there is an electrostatic capacitance distribution in the axial direction of the photosensitive member, a distribution may occur also in phenomena that are changed due to a change in electrostatic capacitance of the photosensitive member, such as a fogging phenomenon and a ghost phenomenon. As a result, there arises a problem in that it becomes difficult to suppress those phenomena entirely in the axial direction of the photosensitive member in an entire electrophotographic system.

In view of the foregoing, as a method of providing an appropriate sensitivity distribution in the photosensitive member, it is effective to cause the photoelectric conversion efficiency of a charge-generating layer in the laminated photosensitive member to have an appropriate distribution.

In Japanese Patent Application Laid-Open No. 2001-305838, there is described a technology involving providing deviation in the thickness of a charge-generating layer in a photosensitive member through speed control at a time of dip coating to cause deviation in the adhesion amount of a trisazo pigment used as a charge-generating substance, to thereby change the value of Macbeth density. Through provision of deviation in a distribution of the Macbeth density in an axial direction of the photosensitive member, the light absorption amount of the charge-generating layer is changed in the axial direction of the photosensitive member to obtain an appropriate distribution in photoelectric conversion efficiency.

In Japanese Patent Application Laid-Open No. 2008-076657, there is described a technology involving using two kinds of liquid droplet ejection heads at a time of inkjet coating, changing a ratio (PB ratio) of a charge-generating substance to a resin in a coating liquid for a charge-generating layer ejected from each of the liquid droplet ejection heads, and controlling a scanning condition of each of the liquid droplet ejection heads, to thereby increase the content of a chlorogallium phthalocyanine pigment used as the charge-generating substance from a center portion to both end portions while keeping the thickness of the charge-generating layer constant in an axial direction of a photosensitive member. By causing the content per unit volume of the charge-generating substance to have an appropriate distribution while keeping the thickness of the charge-generating layer constant, the light absorption amount of the charge-generating layer is changed while the ghost phenomenon is suppressed, to thereby cause photoelectric conversion efficiency to have an appropriate distribution.

In an electrophotographic apparatus, when a DC bias is applied through use of a charging roller serving as a charging unit to output an image, an infinite number of streak-shaped discharge traces (hereinafter sometimes referred to as "charge streaks") may be generated in the output image in the axial direction of the photosensitive member. It is known that this phenomenon is liable to occur when the thickness of the charge-generating layer of the photosensitive member is large. In addition, when the charge-transporting layer is reduced in thickness in this state, the charge streaks tend to disappear. It is considered that the charge streaks are generated by the following mechanism. The discharge state in the vicinity of the charging roller is changed due to the influence of an increase in dark decay caused by an increase in thickness of the charge-generating layer and the influence of an increase in electrostatic capacitance caused by a reduction in thickness of the charge-transporting layer. However, the detail thereof is not clear. In this regard, the following has been found. There is a relationship between the discharge light in the vicinity of the charging roller and the generation behavior of the charge streaks. When the thickness of the charge-generating layer is small, discharge is completed in the vicinity of an upstream side of the charging roller. When the charge-generating layer is increased in thickness, discharge occurs also on a downstream side of the charging roller, and the charge streaks are generated.

Meanwhile, when the charge-transporting layer is reduced in thickness, the discharge on the downstream side of the charging roller is stabilized to suppress the generation of the charge streaks. It is considered that there is a correlation between the phenomenon in which the discharge position is shifted from the upstream side to the downstream side and the generation of the charge streaks, and the generation of the charge streaks is suppressed by stabilizing the discharge behavior.

In order to compensate for light amount insufficiency in an end portion in the axial direction of the photosensitive member, the charge-generating layer has hitherto been increased in thickness from the center to the end portion. Therefore, as a result of the increase in thickness of the charge-generating layer in the end portion, the charge streaks become liable to be generated in the end portion. In view of the foregoing, the present disclosure is directed to providing an electrophotographic photosensitive member capable of suppressing charge streaks that are generated in an end portion in an axial direction of a photosensitive member even when a charge-generating layer is increased in thickness from the center to the end portion in order to compensate for light amount insufficiency in the end portion.

SUMMARY OF THE INVENTION

According to one aspect of the present disclosure, there is provided an electrophotographic photosensitive member including: a cylindrical support; a charge-generating layer; and a charge-transporting layer, wherein, when a region between a center position and a 90% position situated at a 90% of a length of from the center position to one end of the electrophotographic photosensitive member in an axial direction thereof from the center position, is defined as a region X, and a region between the 90% position and the end of the electrophotographic photosensitive member is defined as a region Z, regions obtained by equally dividing the region X into five are defined as regions X1, X2, X3, X4, and X5 in order from the center position, regions obtained by equally dividing the region Z into three are defined as regions Z1, Z2, and Z3 in order from a region closest to the center position, average thicknesses of the charge-generating layer in respective the regions X1, X2, X3, X4, X5, Z1, Z2, and Z3 are represented by DgX1, DgX2, DgX3, DgX4, DgX5, DgZ1, DgZ2, and DgZ3, and average thicknesses of the charge-transporting layer in the respective regions X1, X2, X3, X4, X5, Z1, Z2, and Z3 are represented by DtX1, DtX2, DtX3, DtX4, DtX5, DtZ1, DtZ2, and DtZ3, $DgX1<DgX2<DgX3<DgX4<DgX5$ and $DtX5>DtZ1$ are satisfied.

Further features of the present invention will become apparent from the following description of exemplary embodiments with reference to the attached drawings.

DESCRIPTION OF THE EMBODIMENTS

The present disclosure is described in detail below by way of exemplary embodiments.

[Electrophotographic Photosensitive Member]

An electrophotographic photosensitive member according to at least one embodiment of the present disclosure is characterized by including a charge-generating layer and a charge-transporting layer.

As a method of producing the electrophotographic photosensitive member according to at least one embodiment of the present disclosure, there is given a method involving preparing coating liquids for respective layers described later, applying the coating liquids to a cylindrical support in a desired order of the layers, and drying the coating liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Figure 5:
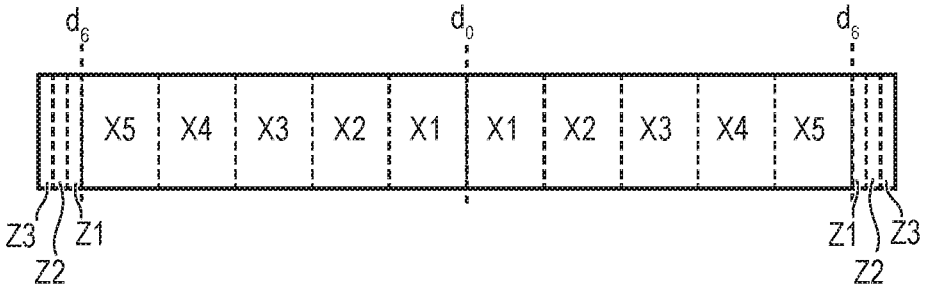
FIG. 5 is a view for illustrating each region of the electrophotographic photosensitive member according to at least one embodiment of the present disclosure.

As illustrated in FIG. 5, in the electrophotographic photosensitive member according to at least one embodiment of the present disclosure, a 90% region between a center position and a 90% position situated at a 90% of a length of from the center position to one end of the electrophotographic photosensitive member in an axial direction thereof from the center position is defined as a region X, and a region between the 90% position and the end of the electrophotographic photosensitive member is defined as a region Z. The region X is further equally divided into five, and the resultant regions are defined as regions X1, X2, X3, X4, and X5 in order from the center position. In addition, the region Z is also further equally divided into three, and the resultant regions are defined as regions Z1, Z2, and Z3 in order from a region closest to the center position. Average thicknesses of the charge-generating layer in the respective regions X1 to X5 and the respective regions Z1 to Z3 are represented by DgX1, DgX2, DgX3, DgX4, DgX5, DgZ1, DgZ2, and DgZ3, and average thicknesses of the charge-transporting layer in the respective regions X1 to X5 and the respective regions Z1 to Z3 are represented by DtX1, DtX2, DtX3, DtX4, DtX5, DtZ1, DtZ2, and DtZ3.

In the electrophotographic photosensitive member according to at least one embodiment of the present disclosure, the charge-generating layer is formed so that the average thicknesses thereof satisfy DgX1<DgX2<DgX3<DgX4<DgX5. For this purpose, it is preferred that dip coating be used as a method of applying the coating liquid for a charge-generating layer, and the thickness of each region be controlled by changing the lifting speed in dip coating. The thickness of each region can be controlled, for example, by setting respective lifting speeds at any ten points in the axial direction of the photosensitive member and smoothly changing the lifting speed between the adjacent two points during dip coating. In this case, the ten points at which the lifting speeds are set are not required to be set in an equally divided manner in the axial direction of the photosensitive member, and it is rather preferred that the lifting speed set points be selected so that values of the lifting speeds are equally divided from the viewpoint of increasing the accuracy of the control of the thickness of each region of the charge-generating layer.

In order to correct a light amount distribution in the axial direction of the photosensitive member, it is required to satisfy DgX1<DgX2<DgX3<DgX4<DgX5. However, in order to set the average thickness DgX5 of the region X5 that is the end portion of the region X to a maximum thickness, it is required to set the average thickness DgZ1 of the region Z1 closer to the end portion in the axial direction of the photosensitive member to a further larger thickness. The foregoing also causes actual constraint, and serves as a factor for generating more charge streaks in the end portion of the photosensitive member. Therefore, when the relationship between DgX5 and DgZ1 is set to DgX5<DgZ1, an average thickness of the charge-generating layer, which satisfactorily suppresses the generation of the charge streaks, can be obtained. Further, when the relationship between DgX5 and DgZ1 is set to DgX5*1.2<DgZ1, an average thickness of the charge-generating layer, which suppresses the generation of the charge streaks more satisfactorily, can be obtained.

Further, with regard to the potential on the photosensitive member, the charge potential is influenced by the thickness of the charge-transporting layer from the viewpoint of electrostatic capacitance. The potential of an exposed portion is influenced by the thickness of the charge-generating layer from the viewpoint of a charge generation amount, and is influenced by the thickness of the charge-transporting layer from the viewpoint of electrostatic capacitance. In at least one embodiment of the present disclosure, the charge generation amount in the axial direction of the photosensitive member is uniformized by adjusting the thickness of the charge-generating layer in accordance with the light amount distribution in the axial direction of the photosensitive member of the electrophotographic apparatus as described above. Further, when the thickness of the charge-transporting layer is uniformized in conformity with the charge-generating layer, the surface potential becomes more uniform, and the density uniformity of the output image can be improved.

In addition, the inventors have made investigations through use of several kinds of evaluation devices, and as a result, have found that a 90% position situated at a 90% of a length of from the center position to the one end of the electrophotographic photosensitive member is appropriate as a boundary for reducing the thickness of the end portion of the charge-transporting layer. When the boundary is set closer to the end portion than to the 90% position, the generation of the charge streaks in the end portion cannot be suppressed. When the boundary is set closer to the center position than to the 90% position, the image density in the end portion becomes low. Therefore, the generation of the charge streaks can be effectively suppressed by reducing the thickness of the end portion of the charge-transporting layer with the 90% position being the boundary.

As described above, in the electrophotographic photosensitive member according to at least one embodiment of the present disclosure, when the charge-transporting layer is formed so that the relationship among the average thicknesses DtX5, DtZ1, DtZ2, and DtZ3 of the charge-transporting layer satisfy DtX5*0.9>DtZ1>DtZ2>DtZ3, the generation of the charge streaks in the end portion can be more effectively suppressed. The average thicknesses DtZ1, DtZ2, and DtZ3 may be 0. Specifically, the charge-transporting layer may not be formed in the region Z.

Further, when the standard deviation of the average thicknesses DtX1, DtX2, DtX3, DtX4, and DtX5 of the charge-transporting layer is set to 0.1 or less, the potential in an image area becomes uniform, and the density uniformity of the output image can be improved.

[Process Cartridge and Electrophotographic Apparatus]

A process cartridge according to at least one embodiment of the present disclosure is characterized by integrally supporting the electrophotographic photosensitive member and at least one unit selected from the group consisting of a charging unit, a developing unit, and a cleaning unit, and being removably mounted onto a main body of an electrophotographic apparatus.

In addition, an electrophotographic apparatus according to at least one embodiment of the present disclosure is characterized by including the electrophotographic photosensitive member, the charging unit, an exposing unit, the developing unit, and the transferring unit.

Figure 1:
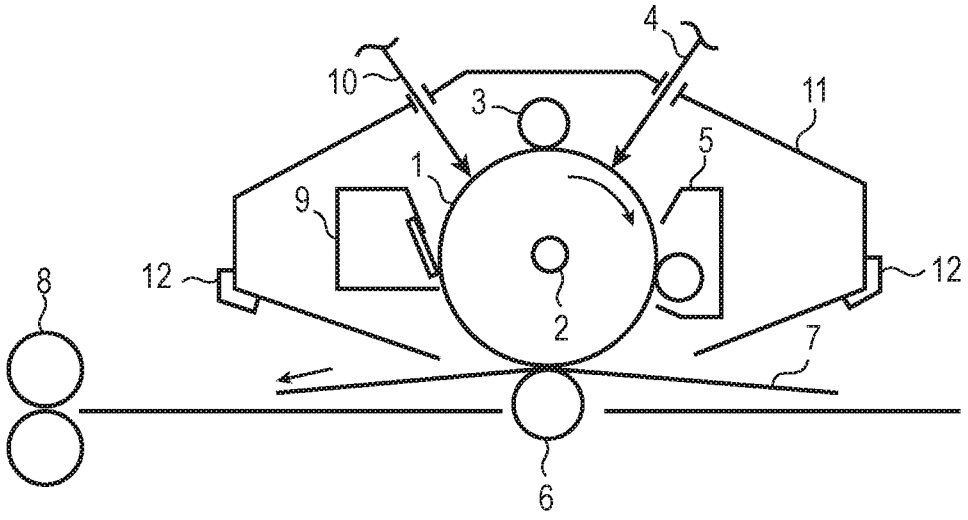
FIG. 1 is a view for illustrating an example of a schematic configuration of an electrophotographic apparatus including a process cartridge including an electrophotographic photosensitive member according to at least one embodiment of the present disclosure.

FIG. 1 is a view for illustrating an example of a schematic configuration of an electrophotographic apparatus including a process cartridge 11 including an electrophotographic photosensitive member.

A cylindrical electrophotographic photosensitive member 1 is configured to be driven to be rotated about a shaft 2 in a direction indicated by the arrow at a predetermined peripheral speed. The surface of the electrophotographic photosensitive member 1 is charged to a predetermined positive or negative potential by a charging unit 3. In FIG. 1, a roller charging system based on a roller-type charging member is illustrated, but a charging system, such as a corona charging system, a proximity charging system, or an injection charging system, may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 having the toner image transferred thereon is conveyed to a fixing unit 8, is subjected to a treatment for fixing the toner image, and is printed out to the outside of the electrophotographic apparatus. The electrophotographic apparatus may include a cleaning unit 9 configured to remove a deposit, such as the toner remaining on the surface of the electrophotographic photosensitive member 1 after the transfer. In addition, a so-called cleaner-less system configured to remove the deposit with the developing unit or the like may be used without separate arrangement of the cleaning unit 9. The electrophotographic apparatus may include an electricity-removing mechanism configured to subject the surface of the electrophotographic photosensitive member 1 to an electricity-removing treatment with pre-exposure light 10 from a pre-exposing unit (not shown). In addition, a guiding unit 12, such as a rail, may be arranged in order to removably mount the process cartridge 11 according to at least one embodiment of the present disclosure onto the main body of the electrophotographic apparatus.

The electrophotographic photosensitive member according to at least one embodiment of the present disclosure can be used in, for example, a laser beam printer, an LED printer, a copying machine, a facsimile, and a multifunctional peripheral thereof.

Figure 2:
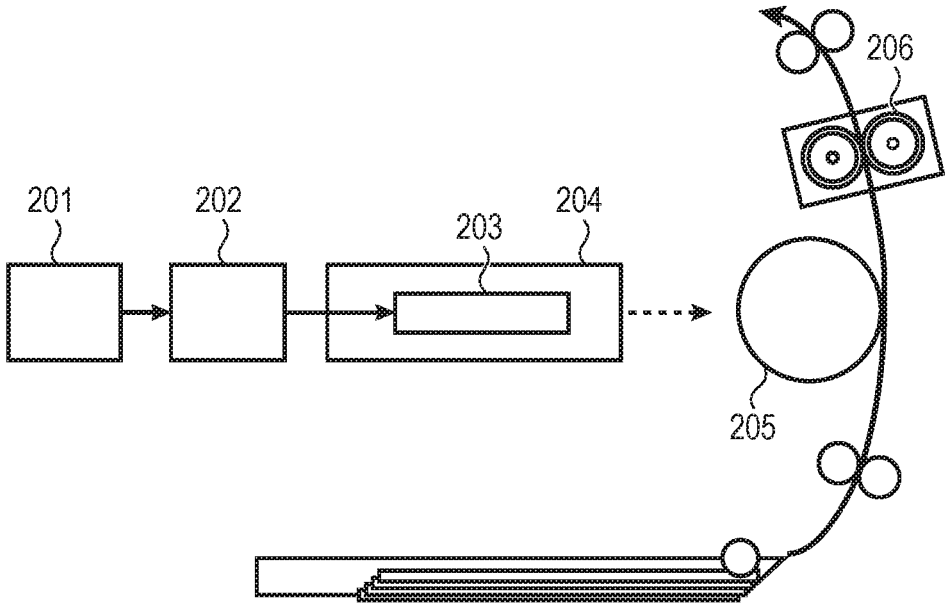
FIG. 2 is a view for illustrating an example of a schematic configuration of an exposing unit of the electrophotographic apparatus including the electrophotographic photosensitive member according to at least one embodiment of the present disclosure.

FIG. 2 is a view for illustrating an example of a schematic configuration of an exposing unit of the electrophotographic apparatus including the electrophotographic photosensitive member according to at least one embodiment of the present disclosure.

A laser driving portion 203 in a laser scanning device 204 that is a laser scanning unit is configured to emit laser scanning light based on an image signal output from an image signal generating unit 201 and a control signal output from a control unit 202. Laser light is scanned over an electrophotographic photosensitive member 205 charged by a charging unit (not shown) to form an electrostatic latent image on the surface of the electrophotographic photosensitive member 205. A transfer material having a toner image obtained from the electrostatic latent image formed on the surface of the electrophotographic photosensitive member 205 is conveyed to a fixing unit 206, is subjected to a treatment for fixing the toner image, and is printed out to the outside of the electrophotographic apparatus.

Figure 3:
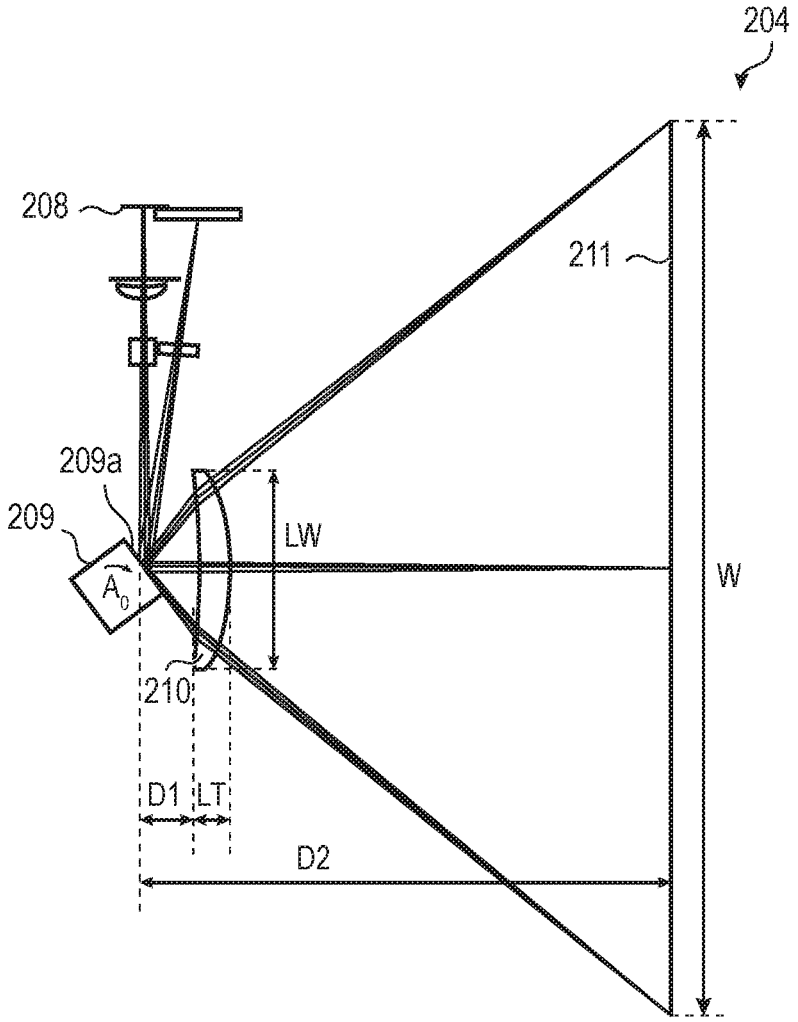
FIG. 3 is a sectional view of a laser scanning device of the electrophotographic apparatus including the electrophotographic photosensitive member according to at least one embodiment of the present disclosure.

FIG. 3 is a sectional view of the laser scanning device 204 of the electrophotographic apparatus including the electrophotographic photosensitive member according to at least one embodiment of the present disclosure.

Laser light (light flux) emitted from a laser light source 208 passes through an optical system. After that, the laser light is reflected from a deflecting surface (reflecting surface) 209*a* of a polygon mirror (deflector) 209, and enters a surface 211 to be scanned of the surface of the photosensitive member through an imaging lens 210. The imaging lens 210 is an imaging optical element. In the laser scanning device 204, an imaging optical system is formed of only the single imaging optical element (imaging lens 210). The laser light having passed through the imaging lens 210 forms an image on the surface 211 to be scanned of the surface of the photosensitive member which the laser light enters, to thereby form a predetermined spot-like image (spot). When the polygon mirror 209 is rotated at a certain angular velocity $A_0$ by a drive unit (not shown), the spot is moved in the axial direction of the photosensitive member on the surface 211 to be scanned of the surface of the photosensitive member, to thereby form an electrostatic latent image on the surface 211 to be scanned of the surface of the photosensitive member.

The imaging lens 210 does not have so-called fθ characteristics. That is, the imaging lens 210 does not have such scanning characteristics that, when the polygon mirror 209 is being rotated at the certain angular velocity $A_0$, the spot of the laser light passing through the imaging lens 210 is moved at a constant speed on the surface 211 to be scanned. Thus, through use of the imaging lens 210 that does not have the fθ characteristics, the imaging lens 210 can be arranged so as to be close to the polygon mirror 209 (at a position at which a distance D1 is small). In addition, the imaging lens 210 that does not have the fθ characteristics can be reduced in width LW and thickness LT as compared to an imaging lens having the fθ characteristics. With the foregoing, the laser scanning device 204 can be downsized. In addition, in the case of a lens having the fθ characteristics, there may be an abrupt change in shape of an incident surface and an exit surface of the lens. When there is such shape constraint, there is a risk in that satisfactory imaging performance may not be obtained. In contrast, the imaging lens 210 does not have the fθ characteristics. Therefore, there is a small abrupt change in shape of an incident surface and an exit surface of the lens, and satisfactory imaging performance can be obtained.

The scanning characteristics of the imaging lens 210 that does not have the fθ characteristics, with which the effects of downsizing, and improving imaging performance are obtained, are represented by the following expression (E3).

$$Y = \frac{K}{B}\tan(B\theta) \tag{E3}$$

In the expression (E3), θ represents a scanning angle of the polygon mirror 209, and Y [mm] represents a focused position (image height) of the laser light in the axial direction of the photosensitive member on the surface 211 to be scanned of the surface of the photosensitive member. In addition, K [mm] represents an imaging coefficient in an on-axis image height, and B represents a coefficient (scanning characteristics coefficient) for determining scanning characteristics of the imaging lens 210. In at least one embodiment of the present disclosure, the on-axis image height refers to an image height ($Y=0=Y_{min}$) on an optical axis and corresponds to the scanning angle θ=0. In addition, an off-axis image height refers to an image height (Y≠0) on an outer side with respect to a center optical axis (at a time of scanning angle θ=0) and corresponds to the scanning angle θ≠0. Further, an outermost off-axis image height refers to an image height ($Y=Y'_{max}$, $-Y'_{max}$) at a time when the scanning angle θ becomes maximum. A scanning width W that is the width in the axial direction of the photosensitive member of a predetermined region (scanning region), in which a latent image can be formed, on the surface 211 to be scanned of the surface of the photosensitive member is represented by $W=|+Y'_{max}|+|-Y'_{max}|$. That is, a center position of the scanning region corresponds to the on-axis image height, and an end position thereof corresponds to the outermost off-axis image height. In addition, the scanning region is larger than an image forming area of the photosensitive member.

Here, the imaging coefficient K is a coefficient corresponding to "f" in the scanning characteristics (fθ characteristics) Y=fθ when it is assumed that the imaging lens 210 has the fθ characteristics. Specifically, the imaging coefficient K is a proportional coefficient in a relational expression of the focused position Y and the scanning angle θ in the same manner as in the fθ characteristics when a light flux other than parallel light enters the imaging lens 210.

Further details about the scanning characteristics coefficient are given below. The expression (E3) at a time of B=0 becomes Y=KO, and hence corresponds to the scanning characteristics Y=fθ of an imaging lens to be used in a related-art optical scanning device. In addition, the expression (E3) at a time of B=1 becomes Y=K·tan θ, and hence corresponds to projection characteristics Y=f·tan θ of a lens to be used in, for example, an image pickup apparatus (camera). Specifically, when the scanning characteristics coefficient B is set within a range of $0 \leq B \leq 1$ in the expression (E3), scanning characteristics between the projection characteristics $Y=f \cdot \tan\theta$ and the scanning characteristics $Y=f\theta$ can be obtained.

Here, when the expression (E3) is differentiated by the scanning angle θ, the scanning speed of the laser light on the surface 211 to be scanned of the surface of the photosensitive member with respect to the scanning angle θ is obtained as represented by the following expression (E4).

$$\frac{dY}{d\theta} = \frac{K}{\cos^2(B\theta)} \tag{E4}$$

Further, the expression (E4) is divided by a speed $Y/\theta=K$ in the on-axis image height, and further, an inverse on both sides is calculated to obtain the following expression (E5).

$$\left(\frac{1}{K}\frac{dY}{d\theta}\right)^{-1} = \cos^2(B\theta) \tag{E5}$$

The expression (E5) represents a ratio of the inverse of the scanning speed in each off-axis image height to the inverse of the scanning speed in the on-axis image height. The total energy of the laser light is constant irrespective of the scanning angle θ. Therefore, the inverse of the scanning speed of the laser light on the surface 211 to be scanned of the surface of the photosensitive member is proportional to an amount [$\mu J/cm^2$] of laser light per unit area applied to a position having the scanning angle θ. Thus, the expression (E5) shows a ratio of the amount of laser light per unit area applied to the surface 211 to be scanned of the surface of the photosensitive member at the scanning angle $\theta \neq 0$ to the amount of laser light per unit area applied to the surface 211 to be scanned of the surface of the photosensitive member at the scanning angle $\theta=0$. When $B \neq 0$, in the laser scanning device 204, the amount of laser light per unit area applied to the surface 211 to be scanned of the surface of the photosensitive member becomes different between the on-axis image height and the off-axis image height.

When the distribution of the laser light amount as described above is present in the axial direction of the photosensitive member, at least one embodiment of the present disclosure having a sensitivity distribution in the axial direction of the photosensitive member can be suitably utilized. Specifically, when the sensitivity distribution that cancels the distribution of the laser light amount is realized with the configuration according to at least one embodiment of the present disclosure, an exposure potential distribution in the axial direction of the photosensitive member becomes uniform. The sensitivity distribution shape required in this case is represented by the following expression (E6) obtained by finding an inverse of the expression (E5).

$$\frac{1}{K}\frac{dY}{d\theta} = \frac{1}{\cos^2(B\theta)} \tag{E6}$$

When the scanning angle corresponding to the end position of the image forming area of the photosensitive member is assumed to be $\theta=\theta_{max}$, a value of the expression (E6) at the scanning angle $\theta=\theta_{max}$ shows a sensitivity ratio "r" required in the photosensitive member when the laser scanning device is combined with the photosensitive member according to at least one embodiment of the present disclosure. Here, the sensitivity ratio "r" is a ratio of the photoelectric conversion efficiency at the end position of the image forming area to the photoelectric conversion efficiency at the center position of the image forming area. When the sensitivity ratio "r" is set, the geometric feature $\theta_{max}$ of the laser scanning device and the scanning characteristics coefficient B of the optical system, which are allowed so as to form a uniform exposure potential distribution in the axial direction of the photosensitive member in the image forming area, are determined. Specifically, when the condition of the following expression (E7) is satisfied, a uniform exposure potential distribution can be obtained in the axial direction of the photosensitive member in the image forming area of the photosensitive member according to at least one embodiment of the present disclosure.

$$r = \frac{1}{\cos^2(B\theta_{max})} \tag{E7}$$

When the expression (E7) is solved for Amax, the following expression (E8) is obtained.

$$\theta_{max} = \frac{1}{B}\arccos\sqrt{r} \tag{E8}$$

Figure 4:
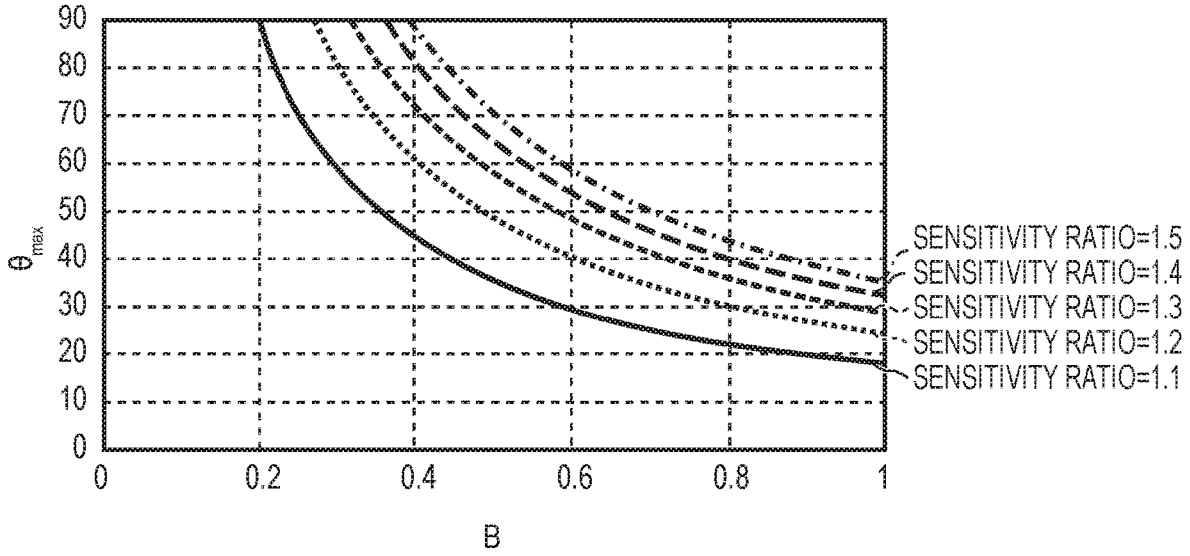
FIG. 4 is a graph for showing a relationship between a scanning characteristics coefficient B and a geometric feature $\theta_{max}$ of the laser scanning device in the expression (E6).

A graph obtained by graphing the expression (E8) is shown in FIG. 4. As is understood from FIG. 4, for example, when the photosensitive member having a sensitivity ratio "r" of 1.2 is combined with the imaging lens 210 having a scanning characteristics coefficient B of 0.5, it is only required that the laser scanning device 204 be designed so as to satisfy $\theta_{max}=48°$. With this, the exposure potential distribution can be uniformized in the image forming area of the photosensitive member. Meanwhile, for example, the case in which the photosensitive member having a sensitivity ratio "r" of 1.1 is combined with the imaging lens 210 having a scanning characteristics coefficient B of 0.5 is considered. In this case, when the laser scanning device 204 is designed so as to satisfy $\theta_{max}=48°$, partial unevenness occurs in the exposure potential distribution in the image forming area of the photosensitive member. In order to obtain a uniform exposure potential distribution in the image forming area of the photosensitive member in this case, it is required to satisfy $\theta_{max}=35°$. This value is smaller than $\theta_{max}=48°$. As Amax becomes larger, an optical path length D2 from the deflecting surface 209*a* to the surface 211 to be scanned of the surface of the photosensitive member illustrated in FIG. 3 becomes shorter, and hence the laser scanning device 204 can be downsized. Thus, when the sensitivity ratio "r" between the center position of the image forming area and the end position of the image forming area in the axial direction of the photosensitive member is increased, the laser beam printer can be downsized when the photosensitive member is used.

Now, the cylindrical support and each layer forming the electrophotographic photosensitive member according to at least one embodiment of the present disclosure are described in detail.

<Cylindrical Support>

In at least one embodiment of the present disclosure, the cylindrical support of the electrophotographic photosensitive member is preferably a conductive support having conductivity. In addition, the cylindrical support is solid or hollow. In addition, the surface of the cylindrical support may be subjected to, for example, an electrochemical treatment, such as anodization, a blast treatment, or a cutting treatment.

A metal, a resin, glass, or the like is preferred as a material for the cylindrical support.

Examples of the metal include aluminum, iron, nickel, copper, gold, stainless steel, and alloys thereof. Of those, an aluminum support using aluminum is preferred.

In addition, conductivity may be imparted to the resin or the glass through a treatment involving, for example, mixing or coating the resin or the glass with a conductive material.

<Conductive Layer>

In at least one embodiment of the present disclosure, it is preferred that a conductive layer be formed on the cylindrical support. Through formation of the conductive layer, flaws and irregularities in the surface of the cylindrical support can be concealed. In addition, through control of the reflection of light on the surface of the cylindrical support, the transmittance can be decreased when an exposure laser having entered the photosensitive member and passed through the charge-generating layer in at least one embodiment of the present disclosure is reflected to enter the charge-generating layer again. Therefore, as compared to the case in which the conductive layer is not formed, the light absorption rate of the incident exposure laser in the charge-generating layer is improved, and the charge-generating layer can be further reduced in average thickness. Therefore, the generation of the end portion streaks can be more effectively suppressed.

The conductive layer preferably contains conductive particles and a resin.

A material for the conductive particles is, for example, a metal oxide, a metal, or carbon black. Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles.

When the metal oxide is used as the conductive particles, the surface of the metal oxide may be treated with a silane coupling agent or the like, or the metal oxide may be doped with an element or an oxide thereof. As the element and the oxide thereof for doping, there are given, for example, phosphorus, aluminum, niobium, and tantalum.

In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide or titanium oxide.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a concealing agent, such as a silicone oil, resin particles, or titanium oxide.

From the viewpoint of more effectively obtaining the sensitivity distribution in the axial direction of the photosensitive member according to at least one embodiment of the present disclosure, it is preferred that the conductive layer have a thickness of more than 10 the conductive layer contain a binder resin and metal oxide fine particles, and the metal oxide fine particles have an average diameter of 100 nm or more and 400 nm or less. When the average diameter of the metal oxide fine particles is 100 nm or more and 400 nm or less, a laser in a wavelength region of submicron order, which has been used as an exposure light source of the electrophotographic apparatus in recent years, is scattered well. In addition, when the thickness of the conductive layer is more than 10 μm, the laser light having entered the photosensitive member travels a distance of 20 μm or more by the time when the laser light passes through the conductive layer, is reflected by the cylindrical support, passes through the conductive layer again, and reaches the charge-generating layer. This distance is 20 times or more the wavelength of the exposure laser to be used, and the laser light that travels such a distance while being scattered sufficiently loses coherency. Therefore, the transmittance of the laser light, which has entered the charge-generating layer again after being reflected, with respect to the charge-generating layer is decreased, and is well absorbed by the charge-generating layer. Therefore, the sensitivity of the photosensitive member is substantially improved. Through the above-mentioned mechanism, with the above-mentioned configuration of the conductive layer, the sensitivity distribution in at least one embodiment of the present disclosure can be effectively obtained even with the small thickness of the charge-generating layer.

In addition, from the viewpoints of effectively obtaining the sensitivity distribution in at least one embodiment of the present disclosure as described above, and simultaneously with this, further improving image quality in the case of using the electrophotographic photosensitive member according to at least one embodiment of the present disclosure, it is more preferred that the metal oxide fine particles contained in the conductive layer each have a core containing titanium oxide and a coating layer that coats the core and contains titanium oxide doped with niobium or tantalum. The titanium oxide has a refractive index higher than that of tin oxide that is often used as the coating layer. Thus, when both the core and the coating layer of the metal oxide fine particles contain titanium oxide, the exposure laser having entered the photosensitive member is hardly allowed to reach the inside of the conductive layer after passing through the charge-generating layer, and is easily reflected or scattered in the vicinity of the interface of the conductive layer on the charge-generating layer side. It is considered that, in the conductive layer, when the exposure laser is scattered more at a position away from the interface of the conductive layer on the charge-generating layer side, the irradiation range of the exposure laser to the charge-generating layer substantially spreads, and the definition of the latent image is decreased, with the result that the definition of the output image is decreased. When the conductive layer having the above-mentioned configuration is combined with the charge-generating layer in at least one embodiment of the present disclosure, both the substantial increase in sensitivity of the photosensitive member brought about by the scattering of the exposure laser and the substantial prevention of the spread of the irradiation range of the exposure laser in the charge-generating layer are achieved, and the image quality can be further improved due to the improvement of the definition of the output image.

The conductive layer may be formed by preparing a coating liquid for a conductive layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

The average particle diameter of the metal oxide fine particles in at least one embodiment of the present disclosure was obtained as described below. Specifically, particles to be measured were observed through use of a scanning electron microscope S-4800 manufactured by Hitachi, Ltd., and the respective particle diameters of 100 particles selected from an image obtained through the observation were measured. The arithmetic average of the particle diameters was calculated and defined as an average diameter (average primary particle diameter). The respective particle diameters were each calculated from the expression (a+b)/2 where "a" and "b" represent the longest side and the shortest side of a primary particle, respectively. In a needle-shaped titanium oxide particle or a flaky titanium oxide particle, an average particle diameter was calculated for each of a long axis diameter and a short axis diameter.

<Undercoat Layer>

In at least one embodiment of the present disclosure, an undercoat layer may be formed on the cylindrical support or the conductive layer. The formation of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably 0.1 μM or more and 50 μm or less, more preferably 0.2 μm or more and 40 μm or less, particularly preferably 0.3 μm or more and 30 μm or less.

The undercoat layer may be formed by preparing a coating liquid for an undercoat layer containing the above-mentioned materials and a solvent, forming a coat thereof, and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

A photosensitive layer of the electrophotographic photosensitive member according to at least one embodiment of the present disclosure is a laminated photosensitive layer including a charge-generating layer containing a charge-generating substance and a charge-transporting layer containing a charge-transporting substance.

(1) Charge-Generating Layer

The charge-generating layer preferably contains the charge-generating substance and a resin.

In at least one embodiment of the present disclosure, the charge-generating layer contains, as the charge-generating substance, a hydroxygallium phthalocyanine crystal described in Japanese Patent Application Laid-Open No. 2000-137340, which has strong peaks at Bragg angles (2θ) of 7.4°±0.3° and 28.2°±0.3° in CuKα characteristic X-ray diffraction, a titanyl phthalocyanine crystal described in Japanese Patent Application Laid-Open No. 2000-137340, which has a strong peak at a Bragg angle (2θ) of 27.2°±0.3° in CuKα characteristic X-ray diffraction, or a chlorogallium phthalocyanine crystal described in U.S. Pat. No. 9,720,337, which has at least one peak each within a wavelength range of 646 nm or more and 668 nm or less and within a wavelength range of 782 nm or more and 809 nm or less in a spectral absorption spectrum, and in which, when a peak exhibiting a maximum absorbance among peaks present within the wavelength range of 646 nm or more and 668 nm or less is defined as a first peak, and a peak exhibiting a maximum absorbance among peaks present within the wavelength range of 782 nm or more and 809 nm or less is defined as a second peak, the absorbance of the first peak is larger than the absorbance of the second peak.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer has a thickness of preferably 10 nm or more and 1,000 nm or less, more preferably 70 nm or more and 300 nm or less.

The average thickness of the charge-generating layer in at least one embodiment of the present disclosure was measured as described below.

First, a region between a center position and a 90% position situated at a 90% of a length of from the center position to one end of the electrophotographic photosensitive member according to at least one embodiment of the present disclosure in an axial direction thereof from the center position is defined as a region X, and a region between the 90% position and the end of the electrophotographic photosensitive member is defined as a region Z. The region X is equally divided into five, and the resultant regions are defined as a region X1, a region X2, a region X3, a region X4, and a region X5 in order from the center position. The region Z is equally divided into three, and the resultant regions are defined as a region Z1, a region Z2, and a region Z3 in order from a region closest to the center position. Each of the regions is further equally divided into four in the axial direction and eight in a circumferential direction to obtain 32 sections. The thicknesses are measured at any measurement points in the respective sections, and average values thereof are defined as average thicknesses of the respective regions of the charge-generating layer. The respective regions X1, X2, X3, X4, X5, Z1, Z2, and Z3 are defined in order from a center portion to an end portion, and average thicknesses of the respective regions were defined as DgX1, DgX2, DgX3, DgX4, DgX5, DgZ1, DgZ2, and DgZ3 [nm].

It is preferred that, when a light absorption coefficient of the charge-generating layer is represented by β [$nm^{-1}$], a thickness distribution of the charge-generating layer be set so that a thickness "$d_0$" [μm] of the charge-generating layer at a center position of the image forming area and a thickness "$d_6$" [μm] of the charge-generating layer at a boundary position between X5 and Z1 satisfy a relationship represented by the following expression (E1).

$$\frac{1-e^{-2\beta d_6}}{1-e^{-2\beta d_0}} \geq 1.2 \quad \text{(E1)}$$

The light absorption coefficient β as used herein is defined by a Beer-Lambert law represented by the following expression (E9).

$$\frac{I}{I_0} = 1 - e^{-\beta d} \quad \text{(E9)}$$

In the expression (E9), $I_0$ represents total energy of light that enters a film having a thickness of "d" [nm], and I represents energy of light absorbed by the film having a thickness of "d" [nm]. In addition, the thickness "do" and the thickness "$d_6$" are each an average value of the thicknesses defined as described below. Specifically, first, regions each having a width of $Y_{max}/20$ [mm] in the axial direction and extending around in the circumferential direction with respect to each of the center position and the end position of the image forming area are considered. In this case, each of the regions is equally divided into four in the axial direction and eight in the circumferential direction to obtain 32 sections. The thicknesses of the charge-generating layer are measured at any measurement points in the respective sections. Then, average values of the obtained measurement values are determined in the respective regions, and are defined as do and $d_6$, respectively.

As is apparent from the expression (E9), the left-side numerator of the expression (E1) represents a light absorption rate of the end portion in the axial direction at the end position of the image forming area, and the left-side denominator thereof represents a light absorption rate of the center portion in the axial direction at the end position of the image forming area. Thus, the expression (E1) shows that the end position of the image forming area has a light absorption rate that is 1.2 times or more that of the center position of the image forming area. With this, a difference in sensitivity of at least 1.2 times can be provided in the image forming area in the axial direction of the photosensitive member. Therefore, the deviation of an actual light amount distribution, which is caused by downsizing of the optical system in a laser scanning system of the electrophotographic apparatus, can be flexibly handled. In addition, a factor 2 is put on an exponent on the shoulder of a base in the expression (E1) because the exposure laser having passed through the charge-generating layer is reflected from the support side of the photosensitive member and passes through the charge-generating layer again.

Further, when the distance from the center position of the image forming area in the axial direction of the photosensitive member is represented by Y [mm], the value of Y at the end position of the imaging forming area is represented by $Y=Y_{max}$ [mm], and the difference between the thicknesses "$d_6$" and "$d_0$" is represented by $\Delta=d_6-d_0$, it is more preferred that the thickness distribution of the charge-generating layer be present between d−0.2Δ and d+0.2Δ with respect to d(Y) calculated by the expression (E2) regarding all the Ys of $0 \leq Y \leq Y_{max}$.

$$d(Y) = d_0 + \Delta(1-\beta\Delta)\frac{Y^2}{Y_{max}^2} + \beta\Delta^2\frac{Y^4}{Y_{max}^4} \quad \text{(E2)}$$

In the expression (E2), Y is the same as the above-mentioned image height Y, and $Y_{max}$ is smaller than the above-mentioned outermost off-axis image height $Y'_{max}$.

The thickness of the charge-generating layer in all the Ys of $0 \leq Y \leq Y_{max}$ is measured as described below. Specifically, a region having a width of $Y_{max}/20$ [mm] in the axial direction of the photosensitive member and extending around in the circumferential direction thereof with respect to a point having a distance of Y [mm] from the center position of the image forming area in the axial direction of the photosensitive member is considered. In this case, the region is equally divided into four in the axial direction and eight in the circumferential direction to obtain 32 measurement points. The thicknesses of the charge-generating layer are measured at the 32 measurement points. Then, an average value of the obtained measurement values is defined as d(Y).

The inventors have found the following. When the charge-generating layer having a thickness distribution represented by the quartic function as in the expression (E2) is formed, the light amount distribution in the axial direction of the photosensitive member when the exposure laser is scanned by the optical system having the characteristics represented by the expression (E3) is appropriately canceled, and the exposure potential distribution in the axial direction of the photosensitive member can be uniformized at a higher level. The mechanism thereof is described below.

As described above, in order to obtain the uniform exposure potential distribution in the optical system having the characteristics represented by the expression (E3), it is only required that the photosensitive member have the sensitivity distribution shape represented by the expression (E6). In at least one embodiment of the present disclosure, the sensitivity is determined based on the photoelectric conversion efficiency calculated by the Beer-Lambert law from the thickness of the charge-generating layer. Therefore, when the left side of the expression (E1) in which $d_5$ is changed to the thickness d(Y) of the charge-generating layer in any Y of $0 \leq Y \leq Y_{max}$ is equal to the right side of the expression (E6), that is, when the following expression (E10) is satisfied, the exposure potential distribution becomes uniform.

$$\frac{1-e^{-2\beta d(Y)}}{1-e^{-2\beta d_0}} = \frac{1}{\cos^2(B\theta)} \tag{E10}$$

The expression (E10) can be modified into the following expression (E11) by substituting the expression (E3) into the expression (E10) through use of a trigonometric function formula: $1+\tan^2(x)=1/\cos^2(x)$.

$$\frac{1-e^{-2\beta d(Y)}}{1-e^{-2\beta d_0}} = 1 + \frac{B^2}{K^2}Y^2 \tag{E11}$$

Here, when the expression (E11) is modified by substituting $Y=Y_{max}$ and $d(Y)=d_6$ into the expression (E11), the following expression (E12) is obtained.

$$\frac{B^2}{K^2} = \left(\frac{1-e^{-2\beta d_6}}{1-e^{-2\beta d_0}} - 1\right)\frac{1}{Y_{max}^2} \tag{E12}$$

When the expression (E12) is solved for d(Y) by substituting the expression (E12) into the expression (E11), the following expression (E13) is obtained.

$$d(Y) = d_0 - \frac{1}{2\beta}\ln\left[1-(1-e^{-2\beta\Delta})\frac{Y^2}{Y_{max}^2}\right] \tag{E13}$$

In the expression (E13), $\Delta=d_6-d_0$ is defined as described above, and ln(·) represents a natural logarithmic function.

The thickness distribution d(Y) of the charge-generating layer represented by the expression (E13) is a precise solution of a thickness distribution required for obtaining the uniform exposure potential distribution in the axial direction of the photosensitive member at a high level in at least one embodiment of the present disclosure.

The inventors have further considered that the expression (E13) is represented by an approximation equation that is established when $Y^2/Y_{max}^2$ and $2\beta\Delta$ are small. With this, the thickness distribution shape of the charge-generating layer, which is preferred in at least one embodiment of the present disclosure, becomes clearer, and in actuality, the thickness distribution can be easily formed by dip coating. Specifically, through use of Maclaurin expansion of ln(1−x) and $e^{-x}$, the expression (E13) is modified into the following expression (E14).

$$d(Y) = d_0 + \frac{1}{2\beta}\sum_{n=1}^{\infty}\frac{1}{n}\left[-\frac{Y^2}{Y_{max}^2}\sum_{m=1}^{\infty}\frac{(2\beta\Delta)^m}{m!}\right]^n \tag{E14}$$

Then, $(Y^2/Y_{max}^2)$ is left up to the second order, and $2\beta\Delta$ is left up to the second order, to thereby obtain the expression (E2) that represents the final thickness distribution of the charge-generating layer.

$$d(Y) = d_0 + \Delta(1-\beta\Delta)\frac{Y^2}{Y_{max}^2} + \beta\Delta^2\frac{Y^4}{Y_{max}^4} \tag{E2}$$

The charge-generating layer may be formed by preparing a coating liquid for a charge-generating layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

In order to obtain the thickness of the charge-generating layer from the state of the electrophotographic photosensitive member, it is only required to take out the charge-generating layer of the electrophotographic photosensitive member by a focused ion beam (FIB) method and subject the charge-generating layer to "Slice & View" analysis through use of a focused ion beam scanning electron microscope (FIB-SEM). The thickness of the charge-generating layer is obtained from a sectional SEM observation image by "Slice & View" analysis through use of the FIB-SEM. In addition, more simply, a method involving obtaining the thickness based on the average specific gravity and the weight of the charge-generating layer may also be used. Still more simply, a method involving acquiring a calibration curve of the Macbeth density of the electrophotographic photosensitive member and the thickness of the charge-generating layer in advance, measuring Macbeth density at each point of the photosensitive member, and converting the measured Macbeth density into the thickness may also be used.

In at least one embodiment of the present disclosure, a calibration curve was acquired based on a Macbeth density value measured by pressing a spectral densitometer (product name: X-Rite 504/508, manufactured by X-Rite Inc.) onto the surface of the photosensitive member and a thickness measurement value obtained by sectional SEM image observation, and a Macbeth density value at each point of the photosensitive member was converted through use of the calibration curve, to thereby measure the average thickness of the charge-generating layer accurately and simply.

In at least one embodiment of the present disclosure, the light absorption coefficient β for each charge-generating substance was obtained as described below. First, the electrophotographic photosensitive member is processed so that the charge-generating layer is exposed to the surface. For example, it is only required that a layer above the charge-generating layer be peeled through use of a solvent or the like. Then, the light reflectance in this state is measured. Subsequently, the charge-generating layer is similarly peeled, and the light reflectance is measured under a state in which an underlying layer of the charge-generating layer is exposed to the surface. The light absorption rate of the single charge-generating layer is calculated through use of the obtained two kinds of reflectances. Meanwhile, the thickness of the charge-generating layer is obtained by the above-mentioned method. A point derived by plotting a natural logarithmic value of the light absorption rate obtained by the above-mentioned method and data on the thickness, and a point with a natural logarithmic value of 0 being a light absorption rate of 100% and a thickness of 0 are connected by a straight line, and an absorption coefficient is obtained from the slope of the straight line.

Powder X-ray diffraction measurement and $^1$H-NMR measurement of a phthalocyanine pigment contained in the electrophotographic photosensitive member according to at least one embodiment of the present disclosure are performed under the following conditions.

(Powder X-ray Diffraction Measurement) Measurement device used: X-ray diffractometer RINT-TTR II, manufactured by Rigaku Corporation
X-ray tube: Cu
X-ray wavelength: Kul
Tube voltage: 50 KV
Tube current: 300 mA
Scanning method: 2θ scan
Scanning speed: 4.0°/min
Sampling interval: 0.02°
Start angle (2θ): 5.0°
Stop angle (2θ): 35.0°
Goniometer: rotor horizontal goniometer (TTR-2)
Attachment: capillary rotating sample stage
Filter: not used
Detector: scintillation counter
Incident monochromator: used
Slit: variable slit (parallel beam method)
Counter monochromator: not used
Divergence slit: open
Divergence vertical limit slit: 10.00 mm
Scattering slit: open
Receiving slit: open ($^1$H-NMR Measurement)
Measuring instrument used: AVANCE III 500, manufactured by Bruker Corporation
Solvent: Deuterated sulfuric acid ($D_2SO_4$)
Number of scans: 2,000

(2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyary late resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer has an average thickness of 5 μm or more and 50 μm or less, more preferably 8 μm or more and 40 μm or less, particularly preferably 10 μm or more and 30 μm or less.

The charge-transporting layer may be formed by preparing a coating liquid for a charge-transporting layer containing the above-mentioned materials and a solvent, forming a coat thereof, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

The thickness of the charge-transporting layer is measured as described below.

First, a region between a center position and a 90% position situated at a 90% of a length of from the center position to one end of the electrophotographic photosensitive member according to at least one embodiment of the present disclosure in an axial direction thereof from the center position is defined as a region X, and a region between the 90% position and the end of the electrophotographic photosensitive member is defined as a region Z. The region X is equally divided into five, and the resultant regions are defined as a region X1, a region X2, a region X3, a region X4, and a region X5 in order from the center position. The region Z is equally divided into three, and the resultant regions are defined as a region Z1, a region Z2, and a region Z3 in order from a region closest to the center position. Average thicknesses in the respective regions X1, X2, X3, X4, X5, Z1, Z2, and Z3 are represented by DtX1, DtX2, DtX3, DtX4, DtX5, DtZ1, DtZ2, and DtZ3 [μm] in order from a center portion to an end portion. Each thickness may be measured by facing a probe of a laser interference thickness meter to the photosensitive member, rotating the photosensitive member in the circumferential direction while performing scanning in the axial direction, and measuring thicknesses at pitch intervals of 1 mm in both the axial direction and the circumferential direction. The obtained values are averaged in the regions of DtX1, DtX2, DtX3, DtX4, DtX5, DtZ1, DtZ2, and DtZ3, respectively, to obtain an average thickness of each region. As the laser interference thickness meter, for example, a laser interference thickness meter SI-T80 manufactured by Keyence Corporation may be used.

Figure 6:
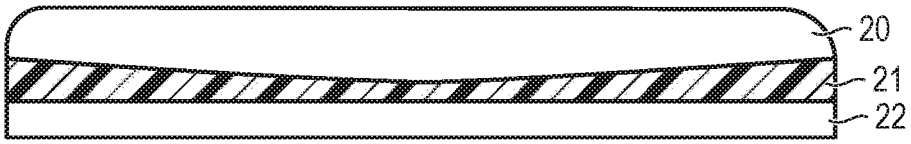
FIG. 6 is a sectional conceptual view of a charge-generating layer and a charge-transporting layer of the electrophotographic photosensitive member according to at least one embodiment of the present disclosure.

An image view of sectional shapes of the charge-generating layer and the charge-transporting layer of the electrophotographic photosensitive member according to at least one embodiment of the present disclosure is illustrated in FIG. 6. In FIG. 6, a charge-generating layer 21 is formed directly on a support 22, but a conductive layer and/or an undercoat layer may be formed between the support 22 and the charge-generating layer 21 as described above. A sensitivity distribution is provided in the charge-generating layer 21 in the axial direction of the photosensitive member so as to cancel a bias in a light amount distribution. In addition, a charge-transporting layer 20 is reduced in thickness in end portions so as to suppress discharge streaks (in other word "charge streaks") generated in the end portions.

<Protective Layer>

In at least one embodiment of the present disclosure, a protective layer may be formed on the photosensitive layer. When the protective layer is formed, durability can be improved.

It is preferred that the protective layer contain conductive particles and/or a charge-transporting substance and a resin. In at least one embodiment of the present disclosure, when the protective layer contains the charge-transporting substance, the average thicknesses DtX1, DtX2, DtX3, DtX4, DtX5, DtZ1, DtZ2, and DtZ3 of the charge-transporting layer are each a sum of the average thicknesses of the charge-transporting layer and the protective layer in the respective regions X1, X2, X3, X4, X5, Z1, Z2, and Z3. Also in this case, the average thickness of each region may be obtained in the same manner as in the average thickness of the charge-transporting layer.

Examples of the conductive particles include particles of metal oxides, such as titanium oxide, zinc oxide, tin oxide, and indium oxide.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

In addition, the protective layer may be formed as a cured film by polymerizing a composition containing a monomer having a polymerizable functional group. As a reaction in this case, there are given, for example, a thermal polymerization reaction, a photopolymerization reaction, and a radiation polymerization reaction. Examples of the polymerizable functional group of the monomer having a polymerizable functional group include an acryl group and a methacryl group. A material having a charge-transporting ability may be used as the monomer having a polymerizable functional group.

The protective layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the protective layer is preferably 0.5 μm or more and 10 μm or less, more preferably 1 μM or more and 7 μm or less.

The protective layer may be formed by preparing a coating liquid for a protective layer containing the above-mentioned materials and a solvent, forming a coat thereof, and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

EXAMPLES

The present disclosure is described in more detail below by way of Examples and Comparative Examples. The present disclosure is by no means limited to the following Examples without departing from the gist of the present disclosure. In the description in the following Examples, "part(s)" is by mass unless otherwise specified.

Synthesis Example 1

5.46 Parts of o-phthalonitrile and 45 parts of α-chloronaphthalene were loaded into a reaction vessel under a nitrogen flow atmosphere and heated to a temperature of 30° C. This temperature was kept. Then, 3.75 parts of gallium trichloride was loaded into the reaction vessel at this temperature (30° C.). The moisture concentration of a mixed liquid at a time of the loading was 150 ppm. After that, the temperature was increased to 200° C. Then, the resultant was allowed to react at a temperature of 200° C. for 4.5 hours under a nitrogen flow atmosphere and cooled. When the temperature reached 150° C., a product was filtered. The obtained filtration residue was dispersed and washed at a temperature of 140° C. for 2 hours through use of N,N-dimethylformamide, followed by filtration. The obtained filtration residue was washed with methanol and dried to obtain a chlorogallium phthalocyanine pigment with a yield of 71%.

Synthesis Example 2

4.65 Parts of the chlorogallium phthalocyanine pigment obtained in Synthesis Example 1 was dissolved in 139.5 parts of concentrated sulfuric acid at a temperature of 10° C. The mixture was dropped to 620 parts of ice water under stirring to be reprecipitated, followed by filtration under reduced pressure through use of a filter press. In this case, No. 5C (manufactured by Advantec) was used as a filter. The obtained wet cake (filtration residue) was dispersed and washed for 30 minutes with 2% ammonia water, followed by filtration through use of the filter press. Then, the obtained wet cake (filtration residue) was dispersed and washed with ion-exchanged water. After that, filtration was repeated three times through use of the filter press. Finally, freeze drying (lyophilization) was performed to obtain a hydroxygallium phthalocyanine pigment (water-containing hydroxygallium phthalocyanine pigment) having a solid content of 23% with a yield of 97%.

Synthesis Example 3

6.6 kg of the hydroxygallium phthalocyanine pigment obtained in Synthesis Example 2 was dried as described below through use of a HYPER-DRY dryer (product name: HD-06R, manufactured by Biocon (Japan) Ltd., frequency (oscillation frequency): 2,455 MHz±15 MHz).

The hydroxygallium phthalocyanine pigment was placed on a dedicated circular plastic tray in a state of a lump taken out from the filter press (water-containing cake thickness: 4 cm or less). Far infrared rays were turned off, and the temperature of an inner wall of the dryer was set to 50° C. A vacuum pump and a leak valve were adjusted during microwave irradiation to adjust a vacuum degree to from 4.0 kPa to 10.0 kPa.

First, as a first step, the hydroxygallium phthalocyanine pigment was irradiated with a microwave of 4.8 kW for 50 minutes. Then, the microwave was temporarily turned off, and the leak valve was temporarily closed, to thereby obtain a high vacuum state of 2 kPa or less. The solid content in the hydroxygallium phthalocyanine pigment at this time was 88%. As a second step, the leak valve was adjusted to adjust a vacuum degree (pressure in the dryer) to within the above-mentioned set values (4.0 kPa to 10.0 kPa). After that, the hydroxygallium phthalocyanine pigment was irradiated with a microwave of 1.2 kW for 5 minutes. In addition, the microwave was temporarily turned off, and the leak valve was temporarily closed, to thereby obtain a high vacuum state of 2 kPa or less. The second step was repeated one more time (twice in total). The solid content in the hydroxygallium phthalocyanine pigment at this time was 98%. Further, as a third step, microwave irradiation was performed in the same manner as in the second step except that the output of the microwave in the second step was changed from 1.2 kW to 0.8 kW. The third step was repeated one more time (twice in total). Further, as a fourth step, the leak valve was adjusted to return the vacuum degree (pressure in the dryer) to within the above-mentioned set values (4.0 kPa to 10.0 kPa). After that, the hydroxygallium phthalocyanine pigment was irradiated with a microwave of 0.4 kW for 3 minutes. In addition, the microwave was temporarily turned off, and the leak valve was temporarily closed, to thereby obtain a high vacuum state of 2 kPa or less. The fourth step was repeated seven more times (eight times in total). Thus, 1.52 kg of a hydroxygallium phthalocyanine pigment (crystal) having a water content of 1% or less was obtained within a total of 3 hours.

Synthesis Example 4

10 Parts of the hydroxygallium phthalocyanine pigment obtained in Synthesis Example 2 and 200 parts of hydrochloric acid at a temperature of 23° C. in a concentration of 35 mass % were mixed with each other, and the mixture was stirred with a magnetic stirrer for 90 minutes. In the mixture in which hydrochloric acid was mixed, the amount of hydrogen chloride was 118 mol with respect to 1 mol of the hydroxygallium phthalocyanine. After the stirring, the resultant was dropped to 1,000 parts of ion-exchanged water cooled with ice water, followed by stirring with the magnetic stirrer for 30 minutes. The resultant was filtered under reduced pressure. In this case, No. 5C (manufactured by Advantec) was used as a filter. After that, dispersion and washing were performed four times with ion-exchanged water at a temperature of 23° C. Thus, 9 parts of a chlorogallium phthalocyanine pigment was obtained.

Synthesis Example 5

In 100 g of a-chloronaphthalene, 5.0 g of o-phthalodinitrile and 2.0 g of titanium tetrachloride were heated and stirred at 200° C. for 3 hours and cooled to 50° C. to precipitate a crystal. The crystal was separated by filtration to obtain a paste of dichlorotitanium phthalocyanine. Next, the paste was stirred and washed with 100 mL of N,N-dimethylformamide heated to 100° C. Then, the resultant was washed repeatedly twice with 100 mL of methanol at 60° C. and separated by filtration. Further, the obtained paste was stirred at 80° C. for 1 hour in 100 mL of deionized water and separated by filtration to obtain 4.3 g of a blue titanyl phthalocyanine pigment.

Next, this pigment was dissolved in 30 mL of concentrated sulfuric acid. The mixture was dropped to 300 mL of deionized water at 20° C. under stirring to be reprecipitated. The resultant was filtered and sufficiently washed with water to obtain an amorphous titanyl phthalocyanine pigment. 4.0 g of the amorphous titanyl phthalocyanine pigment was suspended and stirred in 100 mL of methanol at room temperature (22° C.) for 8 hours. The resultant was separated by filtration and dried under reduced pressure to obtain a titanyl phthalocyanine pigment having low crystallinity.

Milling Example 1

0.5 Part of the hydroxygallium phthalocyanine pigment obtained in Synthesis Example 3, 9.5 parts of N,N-dimethylformamide (product code: D0722, manufactured by Tokyo Chemical Industry Co., Ltd.), and 15 parts of glass beads each having a diameter of 0.9 mm were subjected to a milling treatment at room temperature (23° C.) for 100 hours through use of a ball mill. In this case, the milling treatment was performed through use of, as a container, a standard bottle (product name: PS-6, manufactured by Hakuyo Glass Co., Ltd.) under the condition that the container was rotated 60 times per minute. The liquid thus treated was filtered with a filter (item number: N-NO. 125T, manufactured by NBC Meshtec Inc., pore diameter: 133 μm) to remove the glass beads. 30 Parts of N,N-dimethylformamide was added to this liquid. After that, the mixture was filtered, and a filtration residue on a filter unit was sufficiently washed with tetrahydrofuran. Then, the washed filtration residue was dried in vacuum to obtain 0.48 part of a hydroxygallium phthalocyanine pigment. The obtained pigment has peaks at Bragg angles (2θ) of 7.4°±0.3° and 28.2°±0.3° in an X-ray diffraction spectrum using a CuKα ray.

Milling Example 2

1 Part of the hydroxygallium phthalocyanine pigment obtained in Synthesis Example 3, 9 parts of N-methylformamide (product code: F0059, manufactured by Tokyo Chemical Industry Co., Ltd.), and 15 parts of glass beads each having a diameter of 0.9 mm were subjected to a milling treatment at a cooling water temperature of 18° C. for 80 hours through use of a sand mill (product name: K-800, manufactured by Igarashi Machine Production Co., Ltd. (currently changed to Aimex Co., Ltd.), disc diameter: 70 mm, the number of discs: five). In this case, the milling treatment was performed under the condition that the discs were rotated 400 times per minute. 30 Parts of N-methylformamide was added to the liquid thus treated, and the mixture was filtered. After that, a filtration residue on a filter unit was sufficiently washed with tetrahydrofuran. The washed filtration residue was dried in vacuum to obtain 0.45 part of a hydroxygallium phthalocyanine pigment. The obtained pigment has strong peaks at Bragg angles (2θ) of 7.4°±0.3° and 28.2°±0.3° in an X-ray diffraction spectrum using a CuKα ray. The content of the N-methylformamide in the hydroxygallium phthalocyanine crystal particles, which was estimated by $^{1}$H-NMR measurement, was 0.9 mass % with respect to the content of the hydroxygallium phthalocyanine.

Milling Example 3

A hydroxygallium phthalocyanine pigment of Milling Example 3 was obtained in the same manner as in Milling Example 2 except that the time for the milling treatment was changed from 80 hours to 100 hours in Milling Example 2. The obtained pigment has strong peaks at Bragg angles (2θ) of 7.4°±0.3° and 28.2°±0.3° in an X-ray diffraction spectrum using a CuKα ray. The content of the N-methylformamide in the hydroxygallium phthalocyanine crystal particles, which was estimated by $^{1}$H-NMR measurement, was 1.4 mass % with respect to the content of the hydroxygallium phthalocyanine.

Milling Example 4

0.5 Part of the hydroxygallium phthalocyanine pigment obtained in Synthesis Example 3, 9.5 parts of N-methylformamide (product code: F0059, manufactured by Tokyo Chemical Industry Co., Ltd.), and 15 parts of glass beads each having a diameter of 0.9 mm were subjected to a milling treatment at room temperature (23° C.) for 100 hours through use of a ball mill. In this case, the milling treatment was performed through use of, as a container, a standard bottle (product name: PS-6, manufactured by Hakuyo Glass Co., Ltd.) under the condition that the container was rotated 60 times per minute. The liquid thus treated was filtered with a filter (item number: N-NO. 125T, manufactured by NBC Meshtec Inc., pore diameter: 133 μm) to remove the glass beads. 30 Parts of N-methylformamide was added to this liquid. After that, the mixture was filtered, and a filtration residue on a filter unit was sufficiently washed with tetrahydrofuran. Then, the washed filtration residue was dried in vacuum to obtain 0.45 part of a hydroxygallium phthalocyanine pigment. The obtained pigment has strong peaks at Bragg angles (2θ) of 7.4°±0.3° and 28.2°±0.3° in an X-ray diffraction spectrum using a CuKα ray. The content of the N-methylformamide in the hydroxygallium phthalocyanine crystal particles, which was estimated by $^{1}$H-NMR measurement, was 2.1 mass % with respect to the content of the hydroxygallium phthalocyanine.

Milling Example 5

A hydroxygallium phthalocyanine pigment of Milling Example 5 was obtained in the same manner as in Milling Example 3 except that the time for the milling treatment was changed from 100 hours to 7 hours in Milling Example 3. The obtained pigment has strong peaks at Bragg angles (2θ) of 7.4°±0.3° and 28.2°±0.3° in an X-ray diffraction spectrum using a CuKα ray. The content of the N-methylformamide in the hydroxygallium phthalocyanine crystal particles, which was estimated by $^{1}$H-NMR measurement, was 2.9 mass % with respect to the content of the hydroxygallium phthalocyanine.

Milling Example 6

A hydroxygallium phthalocyanine pigment of Milling Example 6 was obtained in the same manner as in Milling Example 3 except that the time for the milling treatment was changed from 100 hours to 5 hours in Milling Example 3. The obtained pigment has strong peaks at Bragg angles (2θ) of 7.4°±0.3° and 28.2°±0.3° in an X-ray diffraction spectrum using a CuKα ray. The content of the N-methylformamide in the hydroxygallium phthalocyanine crystal particles, which was estimated by $^{1}$H-NMR measurement, was 3.1 mass % with respect to the content of the hydroxygallium phthalocyanine.

Milling Example 7

1.0 Part of the hydroxygallium phthalocyanine pigment obtained in Synthesis Example 3, 9.0 parts of N-methylformamide (product code: F0059, manufactured by Tokyo Chemical Industry Co., Ltd.), and 15 parts of glass beads each having a diameter of 0.9 mm were subjected to a milling treatment at room temperature (23° C.) for 4 hours through use of a ball mill. In this case, the milling treatment was performed through use of, as a container, a standard bottle (product name: PS-6, manufactured by Hakuyo Glass Co., Ltd.) under the condition that the container was rotated 60 times per minute. The liquid thus treated was filtered with a filter (item number: N-NO. 125T, manufactured by NBC Meshtec Inc., pore diameter: 133 μm) to remove the glass beads. 30 Parts of N-methylformamide was added to this liquid. After that, the mixture was filtered, and a filtration residue on a filter unit was sufficiently washed with tetrahydrofuran. Then, the washed filtration residue was dried in vacuum to obtain 0.44 part of a hydroxygallium phthalocyanine pigment. The obtained pigment has strong peaks at Bragg angles (2θ) of 7.4°±0.3° and 28.2°±0.3° in an X-ray diffraction spectrum using a CuKα ray. The content of the N-methylformamide in the hydroxygallium phthalocyanine crystal particles, which was estimated by $^{1}$H-NMR measurement, was 3.9 mass % with respect to the content of the hydroxygallium phthalocyanine.

Milling Example 8

0.5 Part of the titanyl phthalocyanine pigment obtained in Synthesis Example 5, 10 parts of tetrahydrofuran, and 15 parts of glass beads each having a diameter of 0.9 mm were subjected to a milling treatment at a cooling water temperature of 18° C. for 48 hours through use of a sand mill (product name: K-800, manufactured by Igarashi Machine Production Co., Ltd. (currently changed to Aimex Co., Ltd.), disc diameter: 70 mm, the number of discs: five). In this case, the milling treatment was performed under the condition that the discs were rotated 500 times per minute. The liquid thus treated was filtered with a filter (item number: N-NO. 125T, manufactured by NBC Meshtec Inc., pore diameter: 133 μm) to remove the glass beads. 30 Parts of tetrahydrofuran was added to this liquid. After that, the mixture was filtered, and a filtration residue on a filter unit was sufficiently washed with methanol and water. Then, the washed filtration residue was dried in vacuum to obtain 0.45 part of a titanyl phthalocyanine pigment. The obtained pigment has a strong peak at a Bragg angle (2θ) of 27.2°±0.3° in an X-ray diffraction spectrum using a CuKα ray.

Milling Example 9

0.5 Part of the chlorogallium phthalocyanine pigment obtained in Synthesis Example 4 and 10 parts of N,N-dimethylformamide (product code: D0722, manufactured by Tokyo Chemical Industry Co., Ltd.) were subjected to a milling treatment at room temperature (23° C.) for 4 hours through use of a magnetic stirrer. The chlorogallium phthalocyanine pigment was taken out from the liquid thus treated through use of tetrahydrofuran and filtered with a filter (item number: N-NO. 125T, manufactured by NBC Meshtec Inc., pore diameter: 133 μm). A filtration residue on a filter unit was sufficiently washed with tetrahydrofuran. Then, the washed filtration residue was dried in vacuum to obtain 0.46 part of a chlorogallium phthalocyanine pigment. The obtained pigment had a first peak at 659 nm and a second peak at 791 nm in a spectral absorption spectrum by the above-mentioned method, and further the absorbance of the second peak was 0.79 time that of the first peak.

Milling Example 10

0.5 Part of the chlorogallium phthalocyanine pigment obtained in Synthesis Example 4, 10 parts of N,N-dimethylformamide (product code: D0722, manufactured by Tokyo Chemical Industry Co., Ltd.), and 15 parts of glass beads each having a diameter of 0.9 mm were subjected to a milling treatment at room temperature (23° C.) for 48 hours through use of a paint shaker (manufactured by Toyo Seiki Seisaku-sho, Ltd.). In this case, a standard bottle (product name: PS-6, manufactured by Hakuyo Glass Co., Ltd.) was used as a container. The liquid thus treated was filtered with a filter (item number: N-NO. 125T, manufactured by NBC Meshtec Inc., pore diameter: 133 μm) to remove the glass beads. 30 Parts of N,N-dimethylformamide was added to this liquid. After that, the mixture was filtered, and a filtration residue on a filter unit was sufficiently washed with tetrahydrofuran. Then, the washed filtration residue was dried in vacuum to obtain 0.47 part of a chlorogallium phthalocyanine pigment. The obtained pigment had a first peak at 643 nm and a second peak at 789 nm in a spectral absorption spectrum by the above-mentioned method, and further the absorbance of the second peak was 0.74 time that of the first peak. In addition, the obtained pigment has peaks at Bragg angles)(20±0.2° of 7.4°, 16.6°, 25.5°, and 28.3° in an X-ray diffraction spectrum using a CuKα ray.

Production Example 1 of Titanium Oxide Particles

Anatase-type titanium oxide having an average primary particle diameter of 200 nm was used as a base. A titanium-niobium sulfuric acid solution containing 33.7 parts of titanium in terms of $TiO_2$ and 2.9 parts of niobium in terms of $Nb_2O_5$ was prepared. 100 Parts of the base was dispersed in pure water to obtain 1,000 parts of a suspension, and the suspension was warmed to 60° C. The titanium-niobium sulfuric acid solution and 10 mol/L sodium hydroxide were dropped to the suspension over 3 hours so that the pH of the suspension became from 2 to 3. After the total amount had been dropped, the pH was adjusted to a value near a neutral region, and a polyacrylamide-based flocculant was added to the suspension to sediment a solid content. The supernatant was removed, and the residue was filtered and washed, followed by drying at 110° C. Thus, an intermediate containing 0.1 wt % of organic matter derived from the flocculant in terms of C was obtained. The intermediate was calcined in nitrogen at 750° C. for 1 hour, and was then calcined in air at 450° C. to produce titanium oxide particles 1. The obtained particles had an average particle diameter (average primary particle diameter) of 220 nm in the particle diameter measurement method using a scanning electron microscope described above.

Example 1

<Cylindrical Support>

An aluminum cylinder having a length of 257 mm and a diameter of 24 mm (JIS-A3003, aluminum alloy) produced by a production method including an extruding step and a drawing step was used as a cylindrical support.

<Conductive Layer>

50 Parts of a phenol resin (monomer/oligomer of a phenol resin) (product name: PLYOPHEN J-325, manufactured by DIC Corporation, resin solid content: 60%, density after curing: 1.3 g/cm$^3$) serving as a binding material was dissolved in 35 parts of 1-methoxy-2-propanol serving as a solvent. Thus, a solution was obtained.

75 Parts of the titanium oxide particles 1 obtained in "Production Example 1 of Titanium Oxide Particles" were added to the solution, and the mixture was loaded into a vertical sand mill using 120 parts of glass beads having an average particle diameter of 1.0 mm as a dispersing medium, and was subjected to a dispersion treatment under the conditions of a dispersion liquid temperature of 23±3° C. and a number of revolutions of 1,500 rpm (peripheral speed: 5.5 m/s) for 4 hours to provide a dispersion liquid. The glass beads were removed from the dispersion liquid with a mesh. 0.01 Part of a silicone oil (product name: SH28 PAINT ADDITIVE, manufactured by Dow Corning Toray Co., Ltd.) serving as a leveling agent and 8 parts of silicone resin particles (product name: KMP-590, manufactured by Shin-Etsu Chemical Co., Ltd., average particle diameter: 2 μm, density: 1.3 g/cm$^3$) serving as a surface roughness-imparting agent were added to the dispersion liquid after the removal of the glass beads, and the mixture was stirred, followed by filtration under pressure with PTFE filter paper (product name: PF-060, manufactured by Advantec Toyo Kaisha, Ltd.). Thus, a coating liquid for a conductive layer was prepared. Under a normal-temperature and normal-humidity (23° C./50% RH) environment, the coating liquid for a conductive layer thus prepared was applied onto the above-mentioned cylindrical support by dip coating to form a coat, and the coat was cured by heating at 170° C. for 30 minutes, to thereby form a conductive layer having a thickness of 25 μm.

<Undercoat Layer>

Next, 25 parts of N-methoxymethylated nylon 6 (product name: TORESIN EF-30T, manufactured by Nagase ChemteX Corporation) was dissolved in 480 parts of a mixed solution of methanol/n-butanol=2/1 (dissolved by heating at 65° C.) to obtain a solution, and the solution was cooled. After that, the solution was filtered with a membrane filter (product name: FP-022, manufactured by Sumitomo Electric Industries, Ltd., pore diameter: 0.22 μm) to prepare a coating liquid for an undercoat layer. The coating liquid for an undercoat layer thus prepared was applied onto the above-mentioned conductive layer by dip coating to form a coat, and the coat was dried by heating at a temperature of 100° C. for 10 minutes, to thereby form an undercoat layer having a thickness of 0.5 μm.

<Charge-Generating Layer>

Next, 12 parts of the titanyl phthalocyanine pigment obtained in Milling Example 8, 10 parts of polyvinyl butyral (product name: S-LEC BX-1, manufactured by Sekisui Chemical Co., Ltd.), 139 parts of cyclohexanone, and 354 parts of glass beads each having a diameter of 0.9 mm were subjected to a dispersion treatment through use of a sand mill (product name: K-800, manufactured by Igarashi Machine Production Co., Ltd. (currently changed to Aimex Co., Ltd.), disc diameter: 70 mm, the number of discs: five) at a cooling water temperature of 18° C. for 4 hours. In this case, the dispersion treatment was performed under the condition that the discs were rotated 1,800 times per minute. 326 Parts of cyclohexanone and 465 parts of ethyl acetate were added to the dispersion liquid to prepare a coating liquid for a charge-generating layer.

The coating liquid for a charge-generating layer was applied onto the above-mentioned undercoat layer by dip coating, and the lifting speed was gradually changed as shown in Table 1 in accordance with the distance of a liquid surface from an upper end of the support. A coat thus obtained was dried by heating at 100° C. for 10 minutes, to thereby form a charge-generating layer having average thicknesses shown in Table 2. The average thickness of each region of the charge-generating layer was obtained by the above-mentioned method through use of a spectral densitometer (product name: X-Rite 504/508, manufactured by X-Rite Inc.).

TABLE 1

| Distance from upper end of support/mm | Lifting speed/mm/min |
|---|---|
| to 3 | 829 |
| 28 | 605 |
| 53 | 444 |
| 78 | 359 |
| 103 | 307 |
| 128 | 284 |
| 153 | 286 |
| 178 | 314 |
| 203 | 365 |
| 228 | 474 |
| 253 to | 616 |

<Charge-Transporting Layer>

Next, 70 parts of a triarylamine compound represented by the following formula (B1) serving as a charge-transporting substance:

(B1)

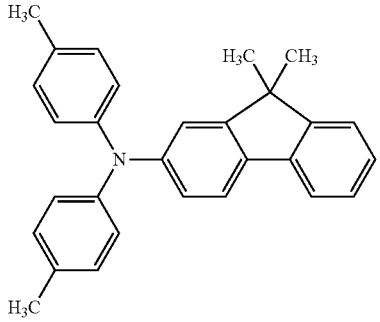

10 parts of a triarylamine compound represented by the following formula (B2):

(B2)

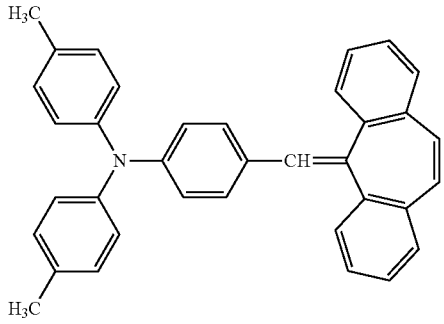

and 100 parts of polycarbonate (product name: Iupilon Z-200, manufactured by Mitsubishi Engineering-Plastics Corporation) were dissolved in 630 parts of monochlorobenzene to prepare a coating liquid for a charge-transporting layer. The coating liquid for a charge-transporting layer thus prepared was applied onto the above-mentioned charge-generating layer by dip coating to form a coat. The coat was dried by heating at a temperature of 120° C. for 1 hour to form a charge-transporting layer having average thicknesses shown in Table 2. The average thickness of each region of the charge-transporting layer was obtained by the above-mentioned method through use of a laser interference thickness meter (product name: SI-T80, manufactured by Keyence Corporation).

As described above, a cylindrical (drum-shaped) electrophotographic photosensitive member was produced. From the average thicknesses of the charge-generating layer and the charge-transporting layer thus obtained, a difference (DtX5-DtZ1) between DtX5 and DtZ1, a difference (DgX5-DgZ1) between DgX5 and DgZ1, a ratio (DtZ1/DtX5) of DtZ1 to DtX5, and a ratio (DgZ1/DgX5) of DgZ1 to DgX5 were obtained on each of an upper side and a lower side of the electrophotographic photosensitive member. The values thereof are shown in Table 3.

(C2)

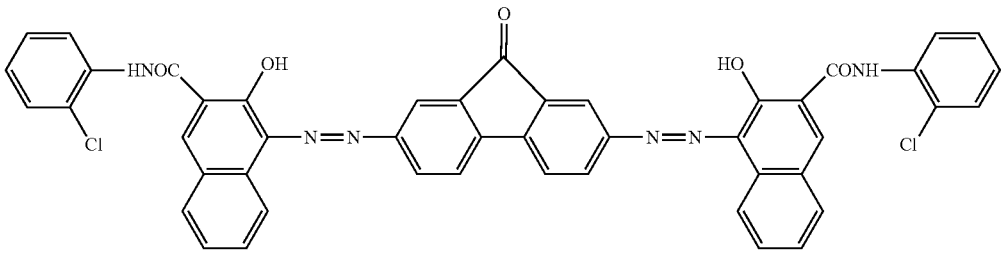

-continued (C3)

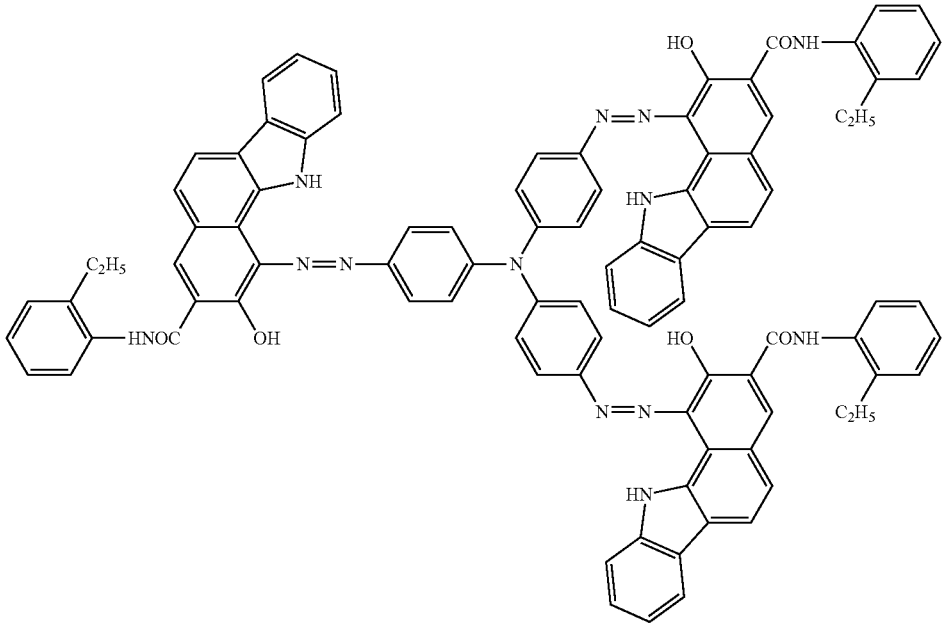

[Evaluation]

Each of the electrophotographic photosensitive members produced in the foregoing was evaluated as described below. The results are shown in Tables 2 to 4.

<Evaluation Device>

A laser beam printer (product name: Color LaserJet CP3525dn) manufactured by Hewlett-Packard Company was prepared as an electrophotographic apparatus to be evaluated, and was used by being reconstructed as described below.

In reconstruction of an optical system, in addition to a default printer without any modifications, a printer, in which the scanning characteristics coefficient B and the geometric feature Omar of the laser scanning device in the expression (8) became (B=0.55 and $\theta_{max}$=55°, was prepared.

In addition, the printer was reconstructed so as to operate while a pre-exposure condition, a charging condition, and a laser exposure amount were variable. In addition, the electrophotographic photosensitive member produced as described above was mounted on a process cartridge for a cyan color, and the resultant was attached to a station of the process cartridge for a cyan color and was allowed to operate even when process cartridges for the other colors (magenta, yellow, and black colors) were not mounted on the main body of the laser beam printer.

At the time of image output, only the process cartridge for a cyan color was attached to the main body of the laser beam printer, and a monochromatic image was output only with cyan toner.

<Evaluation of Solid Image Density Unevenness>

Each of the electrophotographic photosensitive members produced in Examples and Comparative Examples was mounted on the above-mentioned laser beam printer under a normal-temperature and normal-humidity (temperature: 23° C., relative humidity: 50%) environment, and a pre-exposure amount, a charger, and an exposure amount were set so that an initial dark potential became −600 V and an initial light potential became −150 V at a center position of an image forming area of the electrophotographic photosensitive member. For measurement of the surface potential of the electrophotographic photosensitive member at a time of the potential setting, a potential probe (product name: Model 6000B-8, manufactured by Trek Japan KK) mounted at a developing position of the process cartridge was used, and the potential of a center portion of the image forming area of the electrophotographic photosensitive member was measured through use of a surface electrometer (product name: Model 344, manufactured by Trek Japan KK).

Solid images were output under the above-mentioned conditions. The solid images were visually evaluated to be ranked based on the following criteria, and the results are shown as "density uniformity" in Table 4. Ranks A to C correspond to a range in which improvement of the density uniformity can be confirmed as compared to the related art, and which is acceptable as the effects of at least one embodiment of the present disclosure. Meanwhile, a rank D corresponds to the result equivalent to that of the related art, and cannot be accepted as the effects of at least one embodiment of the present disclosure.

A: Density unevenness is not recognized in a solid image.

B: Density unevenness is hardly recognized in a solid image.

C: The density in the vicinity of an end portion of a solid image is high or low, and hence density unevenness is slightly recognized.

D: The density in the vicinity of an end portion of a solid image is extremely low, and hence density unevenness is clearly recognized.

<Charge Streaks in End Portion>

Each of the electrophotographic photosensitive members produced in Examples and Comparative Examples was mounted on the above-mentioned laser beam printer under a normal-temperature and normal-humidity (temperature: 23° C., relative humidity: 50%) environment, and was evaluated as described below. The charge potential was set to −600 V, and the light portion potential after exposure was adjusted so as to be −150 V. In addition, the developing potential was adjusted so as to be −400 V. In this setting, images were output onto A4-size plain paper under the condition that each pixel of 600 dpi was lit at a light emission time of 40%.

Next, the obtained images for evaluation were ranked as described below, and the results are shown as "upper end horizontal charge streaks" and "lower end horizontal charge streaks" in Table 4. Ranks A to C correspond to a range in which suppression of the generation of charge streaks in an end portion can be confirmed as compared to the related art, and which is acceptable as the effects of at least one embodiment of the present disclosure. Meanwhile, a rank D corresponds to the result equivalent to that of the related art, and cannot be accepted as the effects of at least one embodiment of the present disclosure.

A: Charge streaks are not recognized.

B: Charge streaks can be partially determined.

C: Charge streaks can be confirmed over the entire periphery.

D: Clear charge streaks can be confirmed over the entire periphery.

Example 2

In formation of the charge-transporting layer in Example 1, when a coat was formed by dip coating, the lifting speed for lifting the cylindrical support immersed in the coating liquid from the coating liquid was decreased at each of an upper end and a lower end, to thereby reduce the thicknesses at both ends. The obtained coat was dried by heating at 130° C. for 30 minutes to form a charge-transporting layer having average thicknesses shown in Table 2, to thereby produce an electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3.

Examples 3 to 8

In formation of the charge-transporting layer in Example 1, when a coat was formed by dip coating, the lifting speed for lifting the cylindrical support immersed in the coating liquid from the coating liquid was decreased at each of an upper end and a lower end, to thereby reduce the thicknesses at both ends. The obtained coat was dried by heating at 130° C. for 30 minutes to form a charge-transporting layer having average thicknesses shown in Table 2, to thereby produce each electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3.

Example 9

The electrophotographic photosensitive member produced in Example 7 was used. A laser beam printer (product name: Color LaserJet CP4525) manufactured by Hewlett-Packard Company was prepared as an electrophotographic apparatus to be evaluated, and was used by being reconstructed so that a drum surface light amount had the same distribution as that in Example 1.

Example 10

The electrophotographic photosensitive member produced in Example 7 was used. A laser beam printer (product name: Color LaserJet M609) manufactured by Hewlett-Packard Company was prepared as an electrophotographic apparatus to be evaluated, and was used by being reconstructed so that a drum surface light amount had the same distribution as that in Example 1.

Example 11

The electrophotographic photosensitive member produced in Example 7 was used. A laser beam printer (product name: Color LaserJet M552) manufactured by Hewlett-Packard Company was prepared as an electrophotographic apparatus to be evaluated, and was used by being reconstructed so that a drum surface light amount had the same distribution as that in Example 1.

Example 12

An electrophotographic photosensitive member of Example 20 was produced in the same manner as in Example 1 except that the preparation of the coating liquid for a charge-generating layer was changed as described below, and the dip coating of the charge-generating layer was changed so as to achieve the average thicknesses of the charge-generating layer shown in Table 2 by the same method as the above-mentioned method in Example 1.

30 Parts of the chlorogallium phthalocyanine pigment obtained in Milling Example 9, 10 parts of polyvinyl butyral (product name: S-LEC BX-1, manufactured by Sekisui Chemical Co., Ltd.), 253 parts of cyclohexanone, and 643 parts of glass beads each having a diameter of 0.9 mm were subjected to a dispersion treatment through use of a sand mill (product name: K-800, manufactured by Igarashi Machine Production Co., Ltd. (currently changed to Aimex Co., Ltd.), disc diameter: 70 mm, the number of discs: five) at a cooling water temperature of 18° C. for 4 hours. In this case, the dispersion treatment was performed under the condition that the discs were rotated 1,800 times per minute. 592 Parts of cyclohexanone and 845 parts of ethyl acetate were added to the dispersion liquid to prepare a coating liquid for a charge-generating layer.

From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3.

Example 13

In formation of the charge-generating layer in Example 1, the hydroxygallium phthalocyanine pigment obtained in Milling Example 1 was changed to the hydroxygallium phthalocyanine pigment obtained in Milling Example 3, and the dip coating was changed so as to achieve the average thicknesses of the charge-generating layer shown in Table 2 in the same manner as in Example 1, to thereby produce an electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3.

Example 14

In formation of the charge-generating layer in Example 1, 20 parts of the hydroxygallium phthalocyanine pigment obtained in Milling Example 1, 10 parts of polyvinyl butyral (product name: S-LEC BX-1, manufactured by Sekisui Chemical Co., Ltd.), 190 parts of cyclohexanone, and 482 parts of glass beads each having a diameter of 0.9 mm were subjected to a dispersion treatment through use of a sand mill (product name: K-800, manufactured by Igarashi Machine Production Co., Ltd. (currently changed to Aimex Co., Ltd.), disc diameter: 70 mm, the number of discs: five) at a cooling water temperature of 18° C. for 4 hours. In this case, the dispersion treatment was performed under the condition that the discs were rotated 1,800 times per minute. 444 Parts of cyclohexanone and 634 parts of ethyl acetate were added to the dispersion liquid to prepare a coating liquid for a charge-generating layer. A charge-transporting layer having average thicknesses shown in Table 2 was formed in the same manner as in Example 1 except for using the above-mentioned coating liquid for a charge-generating layer, to thereby produce an electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3.

Example 15

In formation of the charge-generating layer in Example 1, 30 parts of the chlorogallium phthalocyanine pigment obtained in Milling Example 10, 10 parts of polyvinyl butyral (product name: S-LEC BX-1, manufactured by Sekisui Chemical Co., Ltd.), 253 parts of cyclohexanone, and 643 parts of glass beads each having a diameter of 0.9 mm were subjected to a dispersion treatment through use of a sand mill (product name: K-800, manufactured by Igarashi Machine Production Co., Ltd. (currently changed to Aimex Co., Ltd.), disc diameter: 70 mm, the number of discs: five) at a cooling water temperature of 18° C. for 4 hours. In this case, the dispersion treatment was performed under the condition that the discs were rotated 1,800 times per minute. 592 Parts of cyclohexanone and 845 parts of ethyl acetate were added to the dispersion liquid to prepare a coating liquid for a charge-generating layer. A charge-transporting layer having average thicknesses shown in Table 2 was formed in the same manner as in Example 1 except for using the above-mentioned coating liquid for a charge-generating layer, to thereby produce an electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3.

Example 16

In formation of the charge-generating layer in Example 1, 20 parts of a disazo compound represented by the formula (C1), 8 parts of polyvinyl butyral (product name: S-LEC BX-1, manufactured by Sekisui Chemical Co., Ltd.), 177 parts of cyclohexanone, and 482 parts of glass beads each having a diameter of 0.9 mm were subjected to a dispersion treatment through use of a sand mill (product name: K-800, manufactured by Igarashi Machine Production Co., Ltd. (currently changed to Aimex Co., Ltd.), disc diameter: 70 mm, the number of discs: five) at a cooling water temperature of 18° C. for 4 hours. In this case, the dispersion treatment was performed under the condition that the discs were rotated 1,800 times per minute. 414 Parts of cyclohexanone and 592 parts of ethyl acetate were added to the dispersion liquid to prepare a coating liquid for a charge-generating layer. A charge-transporting layer having average thicknesses shown in Table 2 was formed in the same manner as in Example 1 except for using the above-mentioned coating liquid for a charge-generating layer, to thereby produce an electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3.

(C1)

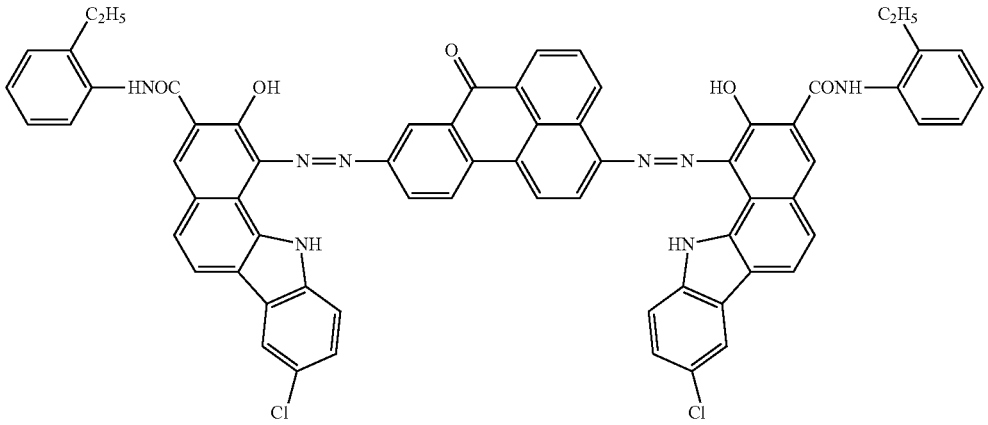

Reference Example 1

In formation of the charge-transporting layer in Example 1, only the division of regions to be evaluated for thickness of the charge-transporting layer was changed. A region between the center position and 85% position situated at a 85% of the length of from the center position to one end of the electrophotographic photosensitive member in an axial direction was defined as X, and a region between the 85% position and the end of the electrophotographic photosensitive member was defined as Z. Specifically, in Table 2, a boundary position between X5 and Z1 in Reference Example 1 corresponds to a 90% position from the center position to the end of the electrophotographic photosensitive member in the axial direction in the charge-generating layer, whereas the boundary position corresponds to a 85% position from the center position to the end of the electrophotographic photosensitive member in the axial direction in the charge-transporting layer. When a coat was formed by subjecting the charge-transporting layer to dip coating, the lifting speed for lifting the cylindrical support immersed in the coating liquid from the coating liquid was changed at each of an upper end and a lower end, to thereby reduce the charge-transporting layer in thickness on both end sides as compared to a center side. Then, the obtained coat was dried by heating at 130° C. for 30 minutes to form a charge-transporting layer having average thicknesses shown in Table 2, to thereby produce an electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3. The same apparatus as that in Example 1 was used as an electrophotographic apparatus to be evaluated.

Reference Example 2

The electrophotographic photosensitive member produced in Reference Example 1 was used, and the same apparatus as that in Example 9 was used as an electrophotographic apparatus to be evaluated.

Reference Example 3

The electrophotographic photosensitive member produced in Reference Example I was used, and the same apparatus as that in Example 10 was used as an electrophotographic apparatus to be evaluated.

Reference Example 4

The electrophotographic photosensitive member produced in Reference Example 1 was used, and the same apparatus as that in Example 11 was used as an electrophotographic apparatus to be evaluated.

Reference Example 5

In formation of the charge-transporting layer in Example 1, only the division of regions to be evaluated for thickness of the charge-transporting layer was changed. A region between the center position and 95% position situated at a 95% of the length of from the center position to one end of the electrophotographic photosensitive member in an axial direction was defined as X, and a region between the 95% position and the end of the electrophotographic photosensitive member was defined as Z. Specifically, in Table 2, a boundary position between X5 and Z1 in Reference Example 5 corresponds to a 90% position from the center position to the end of the electrophotographic photosensitive member in the axial direction in the charge-generating layer, whereas the boundary position corresponds to a 95% position from the center position to the end of the electrophotographic photosensitive member in the axial direction in the charge-transporting layer. When a coat was formed by subjecting the charge-transporting layer to dip coating, the lifting speed for lifting the cylindrical support immersed in the coating liquid from the coating liquid was changed at each of an upper end and a lower end, to thereby reduce the thickness in the region Z as compared to the region X5. Then, the obtained coat was dried by heating at 130° C. for 30 minutes to form a charge-transporting layer having average thicknesses shown in Table 2, to thereby produce an electrophotographic photosensitive member. From the average thicknesses of the charge-generating layer and the charge-transporting layer thus obtained, DtX5-DtZ1, DgX5-DgZ1, DtZ1/DtX5, and DgZ1/DgX5 were obtained on each of an upper side and a lower side of the electrophotographic photosensitive member. The values thereof are shown in Table 3. The same apparatus as that in Example 1 was used as an electrophotographic apparatus to be evaluated.

Reference Example 6

The electrophotographic photosensitive member produced in Reference Example 5 was used, and the same apparatus as that in Example 9 was used as an electrophotographic apparatus to be evaluated.

Reference Example 7

The electrophotographic photosensitive member produced in Reference Example 5 was used, and the same apparatus as that in Example 10 was used as an electrophotographic apparatus to be evaluated.

Reference Example 8

The electrophotographic photosensitive member produced in Reference Example 5 was used, and the same apparatus as that in Example 11 was used as an electrophotographic apparatus to be evaluated.

Comparative Example 1

In formation of the charge-transporting layer in Example 1, when a coat was formed by dip coating, the lifting speed for lifting the cylindrical support immersed in the coating liquid from the coating liquid was not adjusted, to thereby form the coat so that the coat had a substantially uniform thickness distribution. The obtained coat was dried by heating at 130° C. for 30 minutes to form a charge-transporting layer having average thicknesses shown in Table 2, to thereby produce an electrophotographic photosensitive member.

Evaluation of Electrophotographic Photosensitive Members of Examples 2 to 16, Reference Examples 1 to 8, and Comparative Example 1

Evaluation was made on density unevenness of each solid image output through use of the electrophotographic photosensitive members produced in Examples 2 to 16, Reference Examples 1 to 8, and Comparative Example 1 by the same method as that of the electrophotographic photosensitive member produced in Example 1 and charge streaks in an end portion of each image to be evaluated. The results are shown in Table 4.

TABLE 2

| Region | Example 1 | | Example 2 | | Example 3 | | Example 4 | | Example 5 | | Example 6 | | Example 7 | | Examples 8 to 11 | |
|---|---|---|---|---|---|---|---|---|---|---|---|---|---|---|---|---|
| | Charge-gen-erating layer [nm] | Charge-trans-porting layer [μm] | Charge-gen-erating layer [nm] | Charge-trans-porting layer [μm] | Charge-gen-erating layer [nm] | Charge-trans-porting layer [μm] | Charge-gen-erating layer [nm] | Charge-trans-porting layer [μm] | Charge-gen-erating layer [nm] | Charge-trans-porting layer [μm] | Charge-gen-erating layer [nm] | Charge-trans-porting layer [μm] | Charge-gen-erating layer [nm] | Charge-trans-porting layer [μm] | Charge-gen-erating layer [nm] | Charge-trans-porting layer [μm] |
| Upper end side | | | | | | | | | | | | | | | | |
| Z3 | 175 | 14.00 | 175 | 13.20 | 184 | 13.20 | 184 | 13.20 | 184 | 12.80 | 184 | 12.80 | 184 | 12.20 | 184 | 13.20 |
| Z2 | 172 | 14.30 | 172 | 13.60 | 182 | 13.60 | 182 | 13.60 | 182 | 13.00 | 182 | 13.00 | 182 | 13.00 | 182 | 13.60 |
| Z1 | 165 | 14.70 | 165 | 13.80 | 178 | 13.80 | 178 | 13.80 | 178 | 13.20 | 178 | 13.20 | 178 | 13.30 | 178 | 13.80 |
| d6 | 160 | 14.70 | 160 | 14.70 | 165 | 14.70 | 165 | 14.70 | 165 | 14.70 | 165 | 14.70 | 165 | 14.00 | 165 | 14.70 |
| X5 | 140 | 14.80 | 140 | 14.70 | 146 | 14.70 | 146 | 14.70 | 146 | 14.70 | 146 | 14.70 | 146 | 14.80 | 146 | 14.70 |
| X4 | 120 | 14.80 | 120 | 14.80 | 120 | 14.80 | 120 | 14.80 | 120 | 14.80 | 120 | 14.80 | 120 | 14.80 | 120 | 14.80 |
| X3 | 103 | 15.00 | 103 | 15.00 | 103 | 15.00 | 103 | 15.00 | 103 | 15.00 | 103 | 15.00 | 103 | 15.00 | 103 | 15.00 |
| X2 | 94 | 15.20 | 94 | 15.10 | 94 | 15.10 | 94 | 15.10 | 94 | 15.10 | 94 | 15.10 | 94 | 15.01 | 94 | 15.10 |
| X1 | 90 | 15.10 | 90 | 15.10 | 90 | 15.10 | 90 | 15.10 | 90 | 15.10 | 90 | 15.10 | 90 | 15.00 | 90 | 15.10 |
| d0 | 90 | 14.90 | 90 | 15.00 | 90 | 15.00 | 90 | 15.00 | 90 | 15.00 | 90 | 15.00 | 90 | 14.92 | 90 | 15.00 |
| X1 | 90 | 14.80 | 90 | 15.00 | 90 | 15.00 | 90 | 15.00 | 90 | 15.00 | 90 | 15.00 | 90 | 15.00 | 90 | 15.00 |
| X2 | 94 | 14.90 | 94 | 14.90 | 94 | 14.90 | 94 | 14.90 | 94 | 14.90 | 94 | 14.90 | 94 | 14.95 | 94 | 14.90 |
| X3 | 103 | 14.90 | 103 | 14.90 | 103 | 14.90 | 103 | 14.90 | 103 | 14.90 | 103 | 14.90 | 103 | 14.90 | 103 | 14.90 |
| X4 | 119 | 15.00 | 119 | 15.00 | 119 | 15.00 | 119 | 14.90 | 119 | 15.00 | 119 | 14.90 | 119 | 15.00 | 119 | 15.00 |
| X5 | 143 | 15.00 | 143 | 15.00 | 147 | 15.00 | 147 | 14.80 | 147 | 15.00 | 147 | 14.80 | 147 | 14.92 | 147 | 15.00 |
| d6 | 166 | 14.80 | 166 | 14.80 | 166 | 14.80 | 166 | 14.40 | 166 | 14.80 | 166 | 14.40 | 166 | 14.50 | 166 | 14.80 |
| Z1 | 170 | 14.80 | 170 | 14.20 | 177 | 14.20 | 177 | 13.30 | 177 | 14.20 | 177 | 13.30 | 177 | 13.40 | 177 | 14.20 |
| Z2 | 175 | 14.50 | 175 | 14.00 | 185 | 14.00 | 185 | 13.20 | 185 | 14.00 | 185 | 13.20 | 185 | 13.20 | 185 | 14.00 |
| Z3 | 177 | 14.00 | 177 | 13.80 | 190 | 13.80 | 190 | 12.80 | 190 | 13.80 | 190 | 12.80 | 190 | 12.40 | 190 | 13.80 |
| Lower end side | | | | | | | | | | | | | | | | |

TABLE 2-continued

| | Example 12 | | Example 13 | | | | | | | | | | | | | |
|---|---|---|---|---|---|---|---|---|---|---|---|---|---|---|---|---|
| | Charge- | Charge- | Charge- | Charge- | Example 14 | | Example 15 | | Example 16 | | Reference Examples 1 to 4 | | Reference Examples 5 to 8 | | Comparative Example 1 | |
| Region | gen-erating layer [nm] | trans-porting layer [μm] | gen-erating layer [nm] | trans-porting layer [μm] | Charge-generating layer [nm] | Charge-transporting layer [μm] | Charge-generating layer [nm] | Charge-transporting layer [μm] | Charge-generating layer [nm] | Charge-transporting layer [μm] | Charge-generating layer [nm] | Charge-transporting layer [μm] | Charge-generating layer [nm] | Charge-transporting layer [μm] | Charge-generating layer [nm] | Charge-transporting layer [μm] |
| Upper end side | | | | | | | | | | | | | | | | |
| Z3 | 198 | 12.20 | 220 | 12.20 | 190 | 12.20 | 196 | 12.20 | 350 | 12.20 | 184 | 12.20 | 184 | 12.20 | 175 | 14.50 |
| Z2 | 195 | 13.00 | 210 | 13.00 | 183 | 13.00 | 193 | 13.00 | 345 | 13.00 | 182 | 13.00 | 182 | 13.00 | 172 | 14.50 |
| Z1 | 190 | 13.00 | 200 | 13.30 | 180 | 13.30 | 190 | 13.30 | 339 | 13.30 | 178 | 13.30 | 178 | 13.30 | 165 | 14.75 |
| d6 | 175 | 14.00 | 178 | 14.00 | 165 | 14.00 | 175 | 14.00 | 300 | 14.00 | 165 | 14.00 | 165 | 14.00 | 160 | 14.70 |
| X5 | 158 | 14.80 | 166 | 14.80 | 150 | 14.80 | 158 | 14.80 | 282 | 14.80 | 146 | 14.80 | 146 | 14.80 | 140 | 14.80 |
| X4 | 130 | 14.80 | 134 | 14.80 | 128 | 14.80 | 131 | 14.80 | 245 | 14.80 | 120 | 14.80 | 120 | 14.80 | 120 | 14.80 |
| X3 | 113 | 15.00 | 117 | 15.00 | 115 | 15.00 | 114 | 15.00 | 223 | 15.00 | 103 | 15.00 | 103 | 15.00 | 103 | 15.00 |
| X2 | 105 | 15.01 | 106 | 15.01 | 106 | 15.01 | 105 | 15.01 | 207 | 15.01 | 94 | 15.01 | 94 | 15.01 | 94 | 15.20 |
| X1 | 101 | 15.00 | 101 | 15.00 | 101 | 15.00 | 101 | 15.00 | 201 | 15.00 | 90 | 15.00 | 90 | 15.00 | 90 | 15.10 |
| d0 | 100 | 14.92 | 100 | 14.92 | 100 | 14.92 | 100 | 14.92 | 200 | 14.92 | 90 | 14.92 | 90 | 14.92 | 90 | 14.90 |
| X1 | 101 | 15.00 | 101 | 15.00 | 101 | 15.00 | 101 | 15.00 | 201 | 15.00 | 90 | 15.00 | 90 | 15.00 | 90 | 14.80 |
| X2 | 105 | 14.95 | 106 | 14.95 | 106 | 14.95 | 105 | 14.95 | 207 | 14.95 | 94 | 14.95 | 94 | 14.95 | 94 | 14.90 |
| X3 | 113 | 14.90 | 117 | 14.90 | 115 | 14.90 | 114 | 14.90 | 223 | 14.90 | 103 | 14.90 | 103 | 14.90 | 103 | 14.90 |
| X4 | 130 | 15.00 | 134 | 15.00 | 128 | 15.00 | 131 | 15.00 | 245 | 15.00 | 119 | 15.00 | 119 | 15.00 | 119 | 15.00 |
| X5 | 158 | 14.92 | 166 | 14.92 | 150 | 14.92 | 158 | 14.92 | 282 | 14.92 | 147 | 14.92 | 147 | 14.92 | 143 | 15.00 |
| d6 | 175 | 14.50 | 178 | 14.50 | 165 | 14.50 | 175 | 14.50 | 300 | 14.50 | 166 | 14.50 | 166 | 14.50 | 166 | 15.00 |
| Z1 | 190 | 13.40 | 200 | 13.40 | 180 | 13.40 | 190 | 13.40 | 339 | 13.40 | 177 | 13.40 | 177 | 13.40 | 170 | 15.00 |
| Z2 | 195 | 13.20 | 210 | 13.20 | 183 | 13.20 | 193 | 13.20 | 345 | 13.20 | 185 | 13.20 | 185 | 13.20 | 175 | 15.00 |
| Z3 | 198 | 12.40 | 220 | 12.40 | 190 | 12.40 | 196 | 12.40 | 350 | 12.40 | 190 | 12.40 | 190 | 12.40 | 177 | 15.00 |
| Lower end side | | | | | | | | | | | | | | | | |

TABLE 3

| | Example 1 | | Example 2 | | Example 3 | | Example 4 | |
|---|---|---|---|---|---|---|---|---|
| | Upper side | Lower side | Upper side | Lower side | Upper side | Lower side | Upper side | Lower side |
| DtX5-DtZ1 [μm] | 0.10 | 0.20 | 0.90 | 0.80 | 0.90 | 0.80 | 0.90 | 1.50 |
| DgX5-DgZ1 [nm] | 25 | 27 | 25 | 27 | 32 | 30 | 32 | 30 |
| DgZ1/DgX5 | 1.179 | 1.189 | 1.179 | 1.189 | 1.219 | 1.204 | 1.219 | 1.204 |
| DtZ1/DtX5 | 0.993 | 0.987 | 0.939 | 0.947 | 0.939 | 0.947 | 0.939 | 0.899 |

| | Example 5 | | Example 6 | | Example 7 | | Examples 8 to 11 | |
|---|---|---|---|---|---|---|---|---|
| | Upper side | Lower side | Upper side | Lower side | Upper side | Lower side | Upper side | Lower side |
| DtX5-DtZ1 [μm] | 1.50 | 0.80 | 1.50 | 1.50 | 1.50 | 1.52 | 0.90 | 0.80 |
| DgX5-DgZ1 [nm] | 32 | 30 | 32 | 30 | 32 | 30 | 32 | 30 |
| DgZ1/DgX5 | 1.219 | 1.204 | 1.219 | 1.204 | 1.219 | 1.204 | 1.219 | 1.204 |
| DtZ1/DtX5 | 0.898 | 0.947 | 0.898 | 0.899 | 0.899 | 0.898 | 0.939 | 0.947 |

| | Example 12 | | Example 13 | | Example 14 | | Example 15 | |
|---|---|---|---|---|---|---|---|---|
| | Upper side | Lower side | Upper side | Lower side | Upper side | Lower side | Upper side | Lower side |
| DtX5-DtZ1 [μm] | 1.50 | 1.52 | 1.50 | 1.52 | 1.50 | 1.52 | 1.50 | 1.52 |
| DgX5-DgZ1 [nm] | 32 | 32 | 34 | 34 | 30 | 30 | 32 | 32 |
| DgZ1/DgX5 | 1.203 | 1.203 | 1.205 | 1.205 | 1.200 | 1.200 | 1.203 | 1.203 |
| DtZ1/DtX5 | 0.899 | 0.898 | 0.899 | 0.898 | 0.899 | 0.898 | 0.899 | 0.898 |

| | Example 16 | | Reference Examples 1 to 4 | | Reference Examples 5 to 8 | | Comparative Example 1 | |
|---|---|---|---|---|---|---|---|---|
| | Upper side | Lower side | Upper side | Lower side | Upper side | Lower side | Upper side | Lower side |
| DtX5-DtZ1 [μm] | 1.50 | 1.52 | 1.50 | 1.52 | 1.50 | 1.52 | 0.05 | 0 |
| DgX5-DgZ1 [nm] | 57 | 57 | 32 | 30 | 32 | 30 | 25 | 27 |
| DgZ1/DgX5 | 1.202 | 1.202 | 1.219 | 1.204 | 1.219 | 1.204 | 1.179 | 1.189 |
| DtZ1/DtX5 | 0.899 | 0.898 | 0.899 | 0.898 | 0.899 | 0.898 | 0.997 | 1.000 |

TABLE 4

| | Example 1 | Example 2 | Example 3 | Example 4 | Example 5 | Example 6 | Example 7 | Example 8 | Example 9 | Example 10 | Example 11 | Example 12 | Example 13 |
|---|---|---|---|---|---|---|---|---|---|---|---|---|---|
| Upper end horizontal charge streak | C | C | C | C | B | B | B | A | B | B | B | B | B |
| Lower end horizontal charge streak | C | C | C | B | C | B | B | A | B | B | B | B | B |
| Density uniformity | C | C | B | B | B | B | A | B | A | A | A | A | A |

| | Example 14 | Example 15 | Example 16 | Reference Example 1 | Reference Example 2 | Reference Example 3 | Reference Example 4 | Reference Example 5 | Reference Example 6 | Reference Example 7 | Reference Example 8 | Comparative Example 1 |
|---|---|---|---|---|---|---|---|---|---|---|---|---|
| Upper end horizontal charge streak | B | B | B | B | B | B | B | D | D | D | D | D |

TABLE 4-continued

| | | | | | | | | | | | | |
|---|---|---|---|---|---|---|---|---|---|---|---|---|
| Lower end horizontal charge streak | B | B | B | B | B | B | B | D | D | D | D | D |
| Density uniformity | A | A | B | D | D | D | D | A | A | A | A | C |

It is considered that, when the region X of the charge-transporting layer was set to the region between the center position and the 85% position situated at the 85% of the length of from the center position to the one end of the electrophotographic photosensitive member as in Reference Examples 1 to 4, the thickness of the charge-transporting layer was reduced in the image forming area, and hence the density uniformity of the end portion was decreased as shown in Table 4. Meanwhile, it is considered that, when the region X of the charge-transporting layer was set to the region between the center position and the 90% or 95% position situated at the 90% or 95% of a length of from the center position to the one end of the electrophotographic photosensitive member as in Examples 1 to 16 and Reference Examples 5 to 8, the thickness of the charge-transporting layer became constant in the image forming area, and hence the density uniformity was kept.

In addition, the following is considered. When the region X of the charge-transporting layer was set to the region between the center position and the 95% position situated at the 95% of a length of from the center position to the one end of the electrophotographic photosensitive member as in Reference Examples 5 to 8, the region Z of the charge-transporting layer became a 5% region on the end portion side. Even when the thickness of the charge-transporting layer in the region Z was reduced, a change in electrostatic capacitance was small and was not sufficient. Therefore, horizontal charge streaks were generated. Meanwhile, the following is considered. When the region X of the charge-transporting layer was set to the region between the center position and the 90% or 85% position situated at the 90% or 85% of a length of from the center position to the one end of the electrophotographic photosensitive member as in Examples 1 to 16 and Reference Examples 1 to 4, electrostatic capacitance was sufficiently increased by reducing the thickness of the charge-transporting layer in the region Z. Therefore, horizontal charge streaks were not generated, or were partially generated if any.

According to at least one embodiment of the present disclosure, light amount insufficiency in the end portion in the axial direction of the photosensitive member can be compensated for by increasing the thickness of the charge-generating layer from the center to the end portion, and discharge streaks generated in the end portion can be suppressed similarly by reducing the thickness of the charge-transporting layer in the end portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-117814, filed Jun. 25, 2019, and Japanese Patent Application No. 2020-101825, filed Jun. 11, 2020, which are hereby incorporated by reference herein in their entirety.

What is claimed is:

1. An electrophotographic photosensitive member comprising in this order:

a cylindrical support;

a charge-generating layer; and a charge-transporting layer, wherein, when a region between a center position and a 90% position situated at a 90% of a length of from the center position to one end of the electrophotographic photosensitive member in an axial direction thereof from the center position, is defined as a region X, and a region between the 90% position and the end of the electrophotographic photosensitive member is defined as a region Z, regions obtained by equally dividing the region X into five are defined as regions X1, X2, X3, X4, and X5 in order from the center position, regions obtained by equally dividing the region Z into three are defined as regions Z1, Z2, and Z3 in order from a region closest to the center position, average thicknesses of the charge-generating layer in the respective regions X1, X2, X3, X4, X5, Z1, Z2, and Z3 are represented by DgX1, DgX2, DgX3, DgX4, DgX5, DgZ1, DgZ2, and DgZ3, and average thicknesses of the charge-transporting layer in the respective regions X1, X2, X3, X4, X5, Z1, Z2, and Z3 are represented by DtX1, DtX2, DtX3, DtX4, DtX5, DtZ1, DtZ2, and DtZ3, $DgX1<DgX2<DgX3<DgX4<DgX5$ and $DtX5>DtZ1$ are satisfied.

2. The electrophotographic photosensitive member according to claim 1, wherein the DgX5 and the DgZ1 satisfy $DgX5<DgZ1$.

3. The electrophotographic photosensitive member according to claim 1, wherein the DgX5 and the DgZ1 satisfy $DgX5*1.2<DgZ1$.

4. The electrophotographic photosensitive member according to claim 1, wherein the DtX5, the DtZ1, the DtZ2, and the DtZ3 satisfy $DtX5*0.9>DtZ1\geq DtZ2\geq DtZ3$.

5. The electrophotographic photosensitive member according to claim 1, wherein the DtX1, the DtX2, the DtX3, the DtX4, and the DtX5 have a standard deviation of 0.1 or less.

6. A process cartridge comprising:

an electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus, wherein the electrophotographic photosensitive member includes a cylindrical support, a charge-generating layer, and a charge-transporting layer in the stated order, and wherein, when a region between a center position and a 90% position situated at a 90% of a length of from the center position to one end of the electrophotographic photosensitive member in an axial direction thereof from the center position, is defined as a region X, and a region between the 90% position and the end of the electrophotographic photosensitive member is defined as a region Z, regions obtained by equally dividing the region X into five are defined as regions X1, X2, X3, X4, and X5 in order from the center position, regions obtained by equally dividing the region Z into three are defined as regions Z1, Z2, and Z3 in order from a region closest to the center position, average thicknesses of the charge-generating layer in the respective regions X1, X2, X3, X4, X5, Z1, Z2, and Z3 are represented by DgX1, DgX2, DgX3, DgX4, DgX5, DgZ1, DgZ2, and DgZ3, and average thicknesses of the charge-transporting layer in the respective regions X1, X2, X3, X4, X5, Z1, Z2, and Z3 are represented by DtX1, DtX2, DtX3, DtX4, DtX5, DtZ1, DtZ2, and DtZ3, $DgX1<DgX2<DgX3<DgX4<DgX5$ and $DtX5>DtZ1$ are satisfied.

7. An electrophotographic apparatus comprising:

an electrophotographic photosensitive member;

a charging unit;

an exposing unit;

a developing unit; and a transferring unit, wherein the electrophotographic photosensitive member includes a cylindrical support, a charge-generating layer, and a charge-transporting layer in the stated order, and wherein, when a region between a center position and a 90% position situated at a 90% of a length of from the center position to one end of the electrophotographic photosensitive member in an axial direction thereof from the center position, is defined as a region X, and a region between the 90% position and the end of the electrophotographic photosensitive member is defined as a region Z, regions obtained by equally dividing the region X into five are defined as regions X1, X2, X3, X4, and X5 in order from the center position, regions obtained by equally dividing the region Z into three are defined as regions Z1, Z2, and Z3 in order from a region closest to the center position, average thicknesses of the charge-generating layer in the respective regions X1, X2, X3, X4, X5, Z1, Z2, and Z3 are represented by DgX1, DgX2, DgX3, DgX4, DgX5, DgZ1, DgZ2, and DgZ3, and average thicknesses of the charge-transporting layer in the respective regions X1, X2, X3, X4, X5, Z1, Z2, and Z3 are represented by DtX1, DtX2, DtX3, DtX4, DtX5, DtZ1, DtZ2, and DtZ3, $DgX1<DgX2<DgX3<DgX4<DgX5$ and $DtX5>DtZ1$ are satisfied.

* * * * *